US007854046B2

(12) United States Patent
Horn et al.

(10) Patent No.: US 7,854,046 B2
(45) Date of Patent: Dec. 21, 2010

(54) MICROCREPING TRAVELING SHEET MATERIAL

(75) Inventors: J. Drew Horn, Weymouth, MA (US); Peter R. Smith, Sharon, MA (US); Richard C. Walton, Boston, MA (US)

(73) Assignee: Micrex Corporation, Walpole, MA (US)

( * ) Notice: Subject to any disclaimer, the term of this patent is extended or adjusted under 35 U.S.C. 154(b) by 807 days.

(21) Appl. No.: 11/621,020

(22) Filed: Jan. 8, 2007

(65) Prior Publication Data

US 2008/0036135 A1 Feb. 14, 2008

Related U.S. Application Data

(60) Provisional application No. 60/756,793, filed on Jan. 6, 2006.

(51) Int. Cl.
*D06C 21/00* (2006.01)
*D06C 23/04* (2006.01)

(52) U.S. Cl. ..... 26/18.6; 264/282

(58) Field of Classification Search ..... 26/18.6, 26/18.5, 21; 28/155, 165; 425/328; 264/168, 264/282, 283; 162/280, 281, 282, 111, 193
See application file for complete search history.

(56) References Cited

U.S. PATENT DOCUMENTS 1,751,471 A * 3/1930 Campbell ..... 162/280
3,260,778 A 7/1966 Walton
3,416,192 A 12/1968 Packard
3,426,405 A 2/1969 Walton
3,452,409 A 7/1969 Trifunovic et al.
3,597,814 A 8/1971 Trifunovic et al.
3,810,280 A 5/1974 Walton et al.
3,869,768 A * 3/1975 Walton et al. ..... 26/18.6
4,090,385 A 5/1978 Packard
4,142,278 A * 3/1979 Walton et al. ..... 26/18.6
4,432,927 A 2/1984 Van Tilburg et al.
4,717,329 A 1/1988 Packard et al.
4,894,196 A 1/1990 Walton et al.
4,919,877 A * 4/1990 Parsons et al. ..... 264/282
5,060,349 A * 10/1991 Walton et al. ..... 26/18.6

(Continued)

FOREIGN PATENT DOCUMENTS

EP 0454403 A1 10/1991

(Continued)

*Primary Examiner*—Amy B Vanatta
(74) *Attorney, Agent, or Firm*—Fish & Richardson P.C.

(57) ABSTRACT

A stationary working surface of a one roll microcreper member is of plastic resin having low wear and friction properties. As a primary pressing member subject to concentrated force it is 0.040 inch thick. One or both opposed retarder members of a bladed microcreper are of the plastic. Thermoplastics meeting wear and friction limits, e.g. ultra high density polyethylene, are employed. Primary extensions, some having openings, slots or holes serve as flexible retarders to engage treated material. By a load-spreading surface, the thermoplastic primary member is restrained without distortion. By this surface being linear it slideably inserts into a mounting. By this surface being parallel to the roll axis the primary member is free for cross-machine thermal expansion. A primary member shown is sheet form, mounted between sheet metal members, one with a restraint surface. Sheet materials of polyolefins, wood pulp, etc. are dry microcreped at improved rates and materials not heretofore capable of being processed can now be processed.

78 Claims, 15 Drawing Sheets

U.S. PATENT DOCUMENTS 5,117,540 A * 6/1992 Walton et al. ..... 26/18.6
5,666,703 A 9/1997 Walton et al.
5,678,288 A 10/1997 Walton et al.
6,797,226 B2 * 9/2004 Annable ..... 264/282
2004/0149414 A1 8/2004 Watson

FOREIGN PATENT DOCUMENTS

WO WO 01/28766 A1 4/2001

* cited by examiner

MICROCREPING TRAVELING SHEET MATERIAL

RELATED APPLICATION

Under 35 U.S.C. 119(e)(1), this application claims the benefit of prior U.S. provisional application 60/756,793, filed Jan. 6, 2006. The entire disclosure of this prior application is incorporated herein by reference.

TECHNICAL FIELD

This invention relates to the microcreping of traveling flexible sheet materials. It relates both to microcreping flexible sheet materials that have been difficult to microcrepe on a commercial basis due for example to heating or contamination problems, and to microcreping flexible sheet materials at higher speeds or with less wear on machine components than has been attainable previously.

BACKGROUND

"Microcreping", sometimes called "Dry Microcreping," refers to longitudinal treatment of traveling flexible sheet materials under substantially dry conditions in which a drive force is produced by pressing the sheet material against a drive roll. This positively propels the material through a confined retarding passage, with microcreping action on the sheet material occurring in the transition between driving and retarding regions. Because such microcreping does not depend upon adhesion of the sheet material to the drive surface or a wet condition of the material, a particularly wide range of properties is obtainable. (Note: The dry microcreping here described must not be confused with wet creping or creping based on adhesion, performed for instance on a Yankee Dryer. There have been instances in which such processes too have been referred to as "microcreping", though they are completely different, incapable of the results achievable with "dry microcreping".)

"One roll microcreping", i.e. one roll dry microcreping, refers to microcreping that relies upon a single drive roll having a surface capable of mechanically gripping the inner face of the sheet material. A running length of the sheet material is pressed with considerable force face-wise against this moving surface by a stationary pressing member whose face is freely slippable (i.e. smoothly, continuously slippable) relative to the outward face of the material which it engages. Because of the variable geometry of the treatment region made possible with such an arrangement, a particularly wide range of treatments is possible.

A "bladed microcreper" or dry microcreper refers to a one roll microcreper in which retarding is dependent upon extrusion of the treated material between opposed retarder surfaces, the retarder on the roll side being of blade form.

A "bladeless microcreper" or dry microcreper refers to a one roll-microcreper that does not have such a blade.

Depending upon the nature of the flexible sheet material and the conditions of treatment, by microcreping with a one roll microcreper: individual fibers of a sheet material can be crimped while remaining an integral part of the sheet; minute crepes or coarser crepes can be formed in the sheet material as a whole; a desired degree of disruption of bonds between constituent fibers of a sheet material can occur; and softening, drapability and extensibility can be produced or enhanced. Heat-setting is typically employed when the treatment is of web materials having a thermoplastic component.

In such ways, the traveling flexible sheet materials can be softened or rendered permanently elastic; their appearance and feel can be made more like cloth; absorptive qualities of sheet materials can be improved; sheet materials can be given an improved ability to drape or conform about objects; and other useful qualities can be imparted.

Such microcreping is useful with a wide range of materials. For instance: nonwoven sheet materials comprised of natural fibers, synthetic fibers, or blends of the two kinds of fibers in single or multiple layers can be microcreped; plastic films or thicker plastic sheets, and nonwoven or fibrous sheets having a plastic film or metal coating or lamination can be microcreped; paper sheet materials and other sheet products produced from pulp can be microcreped, etc.

The practical development of the one roll microcreper (dry microcreper) traces back to Richard R. Walton and his associates. For instance U.S. Pat. No. 3,260,778, issued Jul. 12, 1966, describes a bladed one-roll microcreper. A material-confining retarder passage is defined between an angled blade-form retarder on one side and a flexible retarder member on the other side of the material. The treated material is forced to move outwardly from between these retarders in an extruding action while continuously, freely slipping past the retarder surfaces. U.S. Pat. No. 3,810,280, issued May 14, 1974, describes a bladeless one-roll microcreper that defines its retarder passage between the drive roll surface and an over-lying stationary retarder member which, rather than allowing the material to freely slip, engages and aggressively retards the material by a mechanical surface retarding effect (as opposed to retarding by confining the material to extrude between freely slippable surfaces, obtained with the bladed microcreper). Over the years, many variations of the one roll microcreper have been developed. A comb roll microcreper is shown in U.S. Pat. No. 4,090,385, issued May 23, 1978 and a bladed microcreper employing tangential extrusion is shown in U.S. Pat. No. 4,894,196, issued Jan. 16, 1990. Efforts to improve the system have continued over many years. For instance U.S. Pat. Nos. 4,717,329, issued Jan. 5, 1988 and 5,060,349, issued Oct. 29, 1991, relate to a replaceable pre-assembled system of the stationary members of a microcreper and U.S. Pat. No. 5,666,703, issued Sep. 16, 1997 and U.S. Pat. No. 5,678,288, issued Oct. 21, 1997, relate to improvements for bladeless microcrepers. Each of these patents is referred to, and in jurisdictions where it is possible, each is hereby incorporated by reference, to illustrate the decades-long effort to improve microcrepers and the wide variety of one roll microcreper arrangements that are possible.

During their long development the one roll microcreper (dry microcreper) treatments were found to be very sensitive to geometric and other variables. In particular it was determined to be vitally important to employ machine elements that are stable and uniform over time in the width and length dimensions of the machine. Bending or buckling, warping or puckering, lengthwise displacement or other geometrical variation of the stationary surfaces engaging the material in the critical driving and retarding regions could not be tolerated.

In this respect, one of the basic findings for the one roll microcreper was the necessity to use a stationary hard metal member such as spring steel as the contact or "primary" member to press the web material against the driven roll to drive the sheet material forward. The surface of the primary member was formed by a low friction, heat-resistant coating applied to the metal member, typically DuPont's Teflon, with the strength and dimensional stability of the metal being relied upon to maintain the working surface within critical geometric tolerances. This primary member was securely held so that a narrow area of its face could be pressed with controlled pressure into freely slippable relation upon the outer face of the flexible sheet material. This pressed the inner face of the material against the gripping surface of the moving roll surface. The resulting strong engagement with the roll surface enabled the flexible sheet material to be positively, mechanically driven forward in its plane, the flexible sheet material slipping forward under the stationary primary member in a continual motion, i.e., freely, without alternate slipping and stopping. By the stationary primary member being principally of metal, it was found that the primary member could be mechanically stable, i.e. without bending or buckling that would introduce non-uniformities to the treatment.

Similarly, in the case of bladed microcreper arrangements, it was also found that the stationary retarder members should likewise be formed of steel or other metal with similar properties.

By observing these conditions, for numerous sheet materials it was found that an acceptable balance was attainable between practical driving and retarding components, speed of operation, heating, wear-rate of the components and the need for a constant geometry of the treatment region across the width and throughout the length of the traveling material. But it also was found that there were significant limitations on use of the process. At desired production high rates, it was found that friction-generated heat at the stationary, freely slippable surfaces could harm many kinds of flexible sheet materials or cause heat distortion of the parts forming the drive and retarding region to disrupt the uniformity of the treatment. When treating many kinds of materials, the stationary slippable surfaces suffered undue wear. Because of such problems as overheating and undue wear, significant limitation on commercial use was thought to be inherent with respect to the kinds of materials that could be treated, the kinds of treatments that could be obtained, and the maximum speed of processing. In many cases, such production problems have made microcreping costly, in other cases microcreping seemed totally impractical.

As an example, many web materials of polymer fibers could not be microcreped commercially for desired end effects because, at commercially acceptable speed, frictional heating of the polymer to high local temperatures produced an excessively deformed or melted polymer state in those regions. For instance, this produced sharp-edges on undulations of the material at the surfaces of the material, providing a harsh sensation to the touch. This has especially been the case for nonwoven material of polyolefin fibers such as polypropylene or polyethylene, which are low cost and widely preferred for the manufacture of disposable diapers, personal care products, etc. Likewise, microcreping plain films and laminates that include films of polypropylene or polyethylene produce sharp and abrasive crepe edges at the surface due to polymer melting that are not acceptable in many cases.

As another example, microcreping of sheet material formed of wood pulp has been limited because of destruction of the stationary primary surface when the process is operated at desired high speeds. This has been the case for products produced of wood pulp such as Kraft papers and for nonwoven wipe products that have a high wood pulp content. In attempting microcreping of products formed of recycled wood pulp that contain abrasive fines, the primary member, i.e. its low friction coating, and soon, the underlying steel surface itself, has been ruined over a brief period of operation.

Other difficulties have arisen with microcreping due to the tendency of migratory substances such as inks to transfer from the materials being treated, producing accumulation of adherent deposits on the treatment surface that disrupt the treatment and involve costly down-time to remove. Another problem has been in respect of barrier coatings in which the process seemed to inherently produce pin holes in the barrier layer.

SUMMARY

We have found, despite common, long-established thinking that steel or similar metal components are required to define stationary members that freely slip on the material, that it is possible instead to form the surfaces by discretely formed members of plastic selected, in respect of the particular material to be treated, as to have physical integrity capable of performing their respective functions without undue friction, wear or distortion. Of particular importance in this regard is forming the stationary primary pressing surface of a one roll microcreper of such plastic. In preferred cases the plastic member is of discrete sheet-form plastic.

In respect of the primary pressing member it has been found that thickness of the pressing member of about 0.040 inch or greater is suitable to provide mass over which concentrated pressing and drag forces are distributed, so that stable geometry in the drive and retarding regions can be maintained.

Other features concern preferred wear and friction property limits for the plastics, the discovery of suitability of certain specific thermoplastics, and the use of special plastics to combat transfer of migratory substances such as inks. Plastics free of fiber reinforcement have been found to combat the problem of pin-holing of barrier film and the like. Preferred forms of the primary member and a unitary extension include openings such as slots or holes in the plastic extension. For operation at temperature below about 220 F, ultra high molecular weight polyethylene has been found to be a preferred thermoplastic material for the primary pressing member and the stationary retarding members.

It has also been discovered that, by having a plastic primary member define an extended load-spreading surface disposed in the cross-machine direction and facing in the direction of advance, the primary member can be restrained without load concentration that distorts the working surface of the member. By forming this surface as a linear slideably-engaged surface the plastic primary member can be slideably inserted into its mounting during assembly. By making the slideable surfaces parallel to the axis of the roll, the primary member comprised of the plastic is made free for cross-machine thermal expansion. Preferred mounting systems are simple to construct and can be used in existing microcreper machines. For instance the primary member can be of sheet form, held between two mounting members at least one having a restraint formation engaged on a wall of the primary member. The wall may be a rear wall of a groove in the plastic member, and the restraint formation a bar carried on a mounting member and inserted in the groove. Importantly, sheet materials of polypropylene, polyethylene and wood pulp can thus be desirably microcreped.

Accordingly, two specific aspects of invention are provided, an apparatus for longitudinally, compressively treating, substantially in the plane of the material, a selected traveling flexible material of substantial width, and a method of treating the material employing the apparatus, the apparatus comprising a drive roll having a gripping surface constructed to mechanically engage a first face of the material when the material is in a substantially dry, unadhering state, a stationary pressing member constructed and mounted so that in a drive region a face of the stationary member can slippably engage and press face-wise against a second, opposite face of the material to force the first face of the material against the gripping surface of the roll to positively advance the material, and at least one stationary retarding member constructed and mounted to cause the retarding member to engage a face of the advancing material in a retarding region to retard the advancing material and cause compressive treatment of the material in a transition zone between the drive and retarding regions, wherein:

at least one of the stationary members is a discrete wear member of plastic held in position to cause one of its surfaces to continually, slippably engage and apply pressure to the face of the traveling material for advancing or retarding the material, the plastic member having dimensions and being of such substance selected in respect of the selected material to be treated as to have physical integrity capable of performing its function without undue friction, wear or distortion.

Preferred implementations of these aspects have one or more of the following features:

The at least one stationary member of the plastic is the pressing member in the drive region, in preferred forms the pressing member comprising a primary member of sheet-form of thickness greater than about 0.040 inch, the sheet-form primary member being supported as a cantilever in a support region that precedes the drive region, the primary member being associated with a pressure device constructed to apply, in the drive region, adjustable pressure substantially in a concentrated width-wise-extending line to an outwardly exposed side of the sheet-form primary member, to force the opposite surface of the primary member to press the traveling material against the gripping surface of the drive roll to cause positive advance of the material, the thickness of the plastic primary member preventing detrimental deformation under the concentrated pressure of the pressure device.

The retarding region comprises a retarding passage defined by two cooperating stationary retarding members arranged to continually, slippably engage opposite sides of the advancing sheet material in manner to apply retarding force as the treated material extrudes from between the members. Preferably, at least one of the retarding members is a sheet- or plate-form wear member of the plastic held in position to cause one of its surfaces to continually, slippably engage and apply pressure to the face of the advancing material to promote retarding of the material.

One of the retarding members is a retarder plate-form member located on the same side of the material as is the drive roll and having a material-engaging diverting surface positioned at a substantial angle to divert the direction of travel of the advancing material, and the cooperating retarder member is a cantilever confining member extending forward from the pressing member in the direction of material travel, the cooperating retarder member being bent or capable of being bent to converge relatively to and then to extend substantially parallel to the diverting surface of the plate-form retarder member, to form therewith an extruding passage through which the treated material is forced to extrude. In preferred forms: the cooperating retarder member is a sheet-form wear member of the plastic held in position to cause one of its surfaces to continually, slippably engage and apply pressure to the face of the advancing material to promote retarding of the material, in certain preferred forms the cooperating retarder member of the plastic being of thickness between about 0.005 inch and 0.015 inch and a support member is arranged to provide support to the outer side of the cooperating member.

When in the form of a bladed microcreper, the cooperating retarder member of plastic is a sheet-form member formed independently of the stationary pressing member, the cooperating retarding member having a rearward margin held against an outwardly directed surface of the pressing member for support. Preferably a sheet form support member engages an outwardly directed surface of the cooperating retarder member.

In the apparatus having one or both retarder members of the plastic, preferably the cooperating pressing member is a sheet-form wear member of plastic, it is held in position to cause one of its surfaces to continually, slippably engage and apply pressure to the face of the traveling material to promote advance of the material, the plastic pressing member having dimensions and being of such substance selected in respect of the selected material to be treated as to have physical integrity capable of performing its function without undue friction, wear or distortion, in some instances the cooperating member being an integral extension of the pressing member, forming therewith a unitary part comprised of plastic, the cooperating member being the same thickness as the primary member, or being of reduced thickness, depending upon the treatment desired. In some instances, in either form, the cooperating member has a series of openings, e.g. holes or slots, in the material-engaging surface the series of openings extending across the width of the traveling material.

In blade-type microcrepers, the plate-form retarder (relative to which the cooperating retarder member converges and then extends substantially parallel to the diverting surface of the plate-form retarder member, to form therewith an extruding passage through which the treated material is forced to extrude), is a wear member of the plastic held in position to cause one of its surfaces to continually, slippably engage the face of the advancing material to promote retarding of the material.

Preferred aspects of invention also concern the particular plastics selected. These aspects include:

One or more of the stationary material-engaging surfaces is defined substantially by a plastic comprised substantially of a plastic resin selected from the group consisting of ultra high molecular weight polyethylene, nylon, polyetheretherketone and copolymers and compatible blends in which one or more of the foregoing is a constituent.

One or more of the stationary surfaces is defined by a plastic having a wear coefficient less than about 100 under the test ASTM G-65.

One or more of the stationary surfaces of plastic has a coefficient of friction of about 0.15 or less under the test ASTM D-1894.

For adapting the apparatus to longitudinally compressively treat a predetermined flexible sheet material having a predetermined treatment temperature, the plastic of the one or more stationary members of plastic is selected to be stable at that temperature, to have a wear coefficient less than about 100 under the test ASTM G-65 and to have a coefficient of friction of about 0.15 or less under the test ASTM D-1894.

For adapting the apparatus to longitudinally compressively treat a flexible sheet material comprised of a polyolefin resin, at least one of the stationary members is comprised substantially of a selected polyolefin or a copolymer or compatible blend in which it is a constituent; preferably the selected plastic resin is substantially comprised of ultra high molecular weight polyethylene or a copolymer or compatible blend in which it is a constituent.

For adapting the apparatus to longitudinally compressively treat material at a temperature of treatment under about 220 F, the at least one stationary member is comprised substantially of ultra high molecular weight polyethylene, nylon or polyetheretherketone or a copolymer or compatible blend in which one of the foregoing is a constituent.

For adapting the apparatus to longitudinally compressively treat material at a temperature of treatment above about 220 F, the stationary member is comprised substantially of nylon 6,6 or polyetheretherketone or a copolymer or compatible blend in which one of the foregoing is a constituent.

For adapting the apparatus to longitudinally compressively treat substantially dry flexible sheet material comprised of wood pulp at an operating speed of about 800 feet per minute or greater, the plastic of the stationary member is selected to have a wear coefficient less than about 100 under the test ASTM G-65; in preferred forms the plastic has a coefficient of friction of about 0.15 or less under the test ASTM D-1894.

For adapting the apparatus to longitudinally compressively treat substantially dry flexible sheet material comprised of wood pulp at an operating speed of about 800 feet per minute or greater, the stationary member is comprised substantially of ultra high molecular weight polyethylene, nylon or polyetheretherketone or a copolymer or compatible blend in which one of the foregoing is a constituent.

For adapting the apparatus to longitudinally compressively treat selected material which carries a substance that is subject to migration to a plastic stationary member, the member is comprised of a plastic selected to resist or interfere with adhesion of the migratory substance. Preferred implementations have one or more of the following features: the plastic is a plastic resin that includes a substance that resists or interferes with adhesion of the migratory substance; the plastic is an oil-filled plastic; the selected material to be treated is comprised of polyethylene or a copolymer or blend in which polyethylene is a substantial constituent, the migratory substance is ink and the plastic of the stationary member is comprised substantially of an oil-filled nylon.

For adapting the process to the treatment of flexible materials carrying a barrier layer or impermeable film or layer, plastic that is not fiber reinforced is employed.

Other aspects of invention concern the mounting of a sheet form plastic primary pressing member. These have one or more of the following features:

The apparatus has a material-engaging device which includes a primary pressing member of the plastic in the drive region and at least one support member having a coefficient of thermal expansion substantially lower than that of the primary member of plastic, the material-engaging device including a mounting of the primary member constructed to permit its free cross-machine thermal expansion relative to the support member having the lower coefficient of thermal expansion. Preferred forms have one or more of the following features: the primary member of plastic defines at least one extended load-spreading surface disposed in the cross-machine direction and facing in the direction of advance of the traveling material and a mounting includes a corresponding restraint surface engaged upon the load-spreading surface to resist drag force applied by the traveling material to the primary member, preferably the load-spreading surface of the plastic primary member and the corresponding restraint surfaces being linear surfaces constructed and arranged to be slideably engaged during assembly; preferably, the extended load-spreading surface is a linear surface that is disposed parallel to the axis of the drive roll, and the restraint surface is correspondingly linear and is slideably engaged upon the load-spreading surface to permit free cross-machine thermal expansion of the primary member of plastic; preferably the load-spreading surface is provided by a wall formation of the primary member, for instance the wall bounds a groove formed in the plastic body of the primary member.

In the apparatus, preferably, the primary member is held between upper and lower mounting members that form part of an assembly, at least one of the mounting members providing a restraint surface engaged upon the load-spreading surface to resist drag force applied by the traveling material to the primary member. In this case, the implementation preferably has one or more of the following features: the mounting member extends forward over an upper face of the primary member to an end lying forward, beyond the line of action of the pressing device and the lower mounting member extends forward to an end located to the rear of the pressing device; a linear load-spreading surface of the primary member is the forwardly directed rear wall of a groove formed in an upper or lower surface of the primary member and the linear restraint surface is defined by a rearwardly directed surface of a formation provided by the corresponding mounting member.

In preferred forms, portions of the assembly to the rear of the primary member are joined by a cross-machine series of fasteners held in a corresponding groove of a holder.

Another important aspect of invention concerns methods of providing an apparatus having one or more of the features mentioned, and processing with it the various sheet materials mentioned above with respect to the features of the invention and the other materials mentioned elsewhere in this specification.

Another aspect of invention concerns, per se, a primary pressing member constructed for use in an apparatus for longitudinally compressively treating a selected traveling flexible sheet material substantially in the plane of the material, the apparatus having a drive roll for advancing the material, at least one retarder engageable with the material driven forward by the roll, and a primary pressing member for pressing the material against the surface of the drive roll in a drive region before the material engages the retarder, the primary member defining a material-engaging surface for continually slippably engaging the material, the surface extending cross-machine across the width of the material on the drive roll, and a pressing device to apply adjustable pressure to the primary member to cause the primary member to press the traveling material against the drive roll surface over a pressing region across the width of the material, wherein at least the portion of the primary member constructed to engage the traveling flexible sheet material over the pressing region is a wear-member comprising plastic capable of continually, slippably engaging the traveling material, the plastic wear member having dimensions and being of such substance selected in respect of the selected material to be treated as to have physical integrity capable of performing its function without undue friction, wear or distortion.

Preferred implementations of this aspect have one or more of the features described above generally with respect to stationary members of the apparatus, or described specifically with respect to the pressing member or primary pressing member employed in the drive region of the apparatus.

The details of one or more implementations are set forth in the accompanying drawings and the description below. Other features, objects, and advantages will be apparent from the description and drawings, and from the claims.

DESCRIPTION OF DRAWINGS

FIG. 4 is a magnified view of operative parts of the microcreper of FIG. 1 with the primary assembly of FIGS. 3-3C in place while

FIG. 5 is an exploded view, similar to FIG. 3, of the parts of a primary assembly featuring another thermoplastic primary member while

FIG. 8 is a side cross-sectional view of another primary member defining a step and reduced thickness at its downstream extension while

FIG. 9 is a cross-sectioned perspective view of another primary member defining fingers in its downstream extension while

FIG. 10 is a cross-sectional view of another primary member in which a series of apertures is formed through the thickness of the primary member in the transition region while

Like reference symbols in the various drawings indicate like elements.

DETAILED DESCRIPTION

Figure 1:
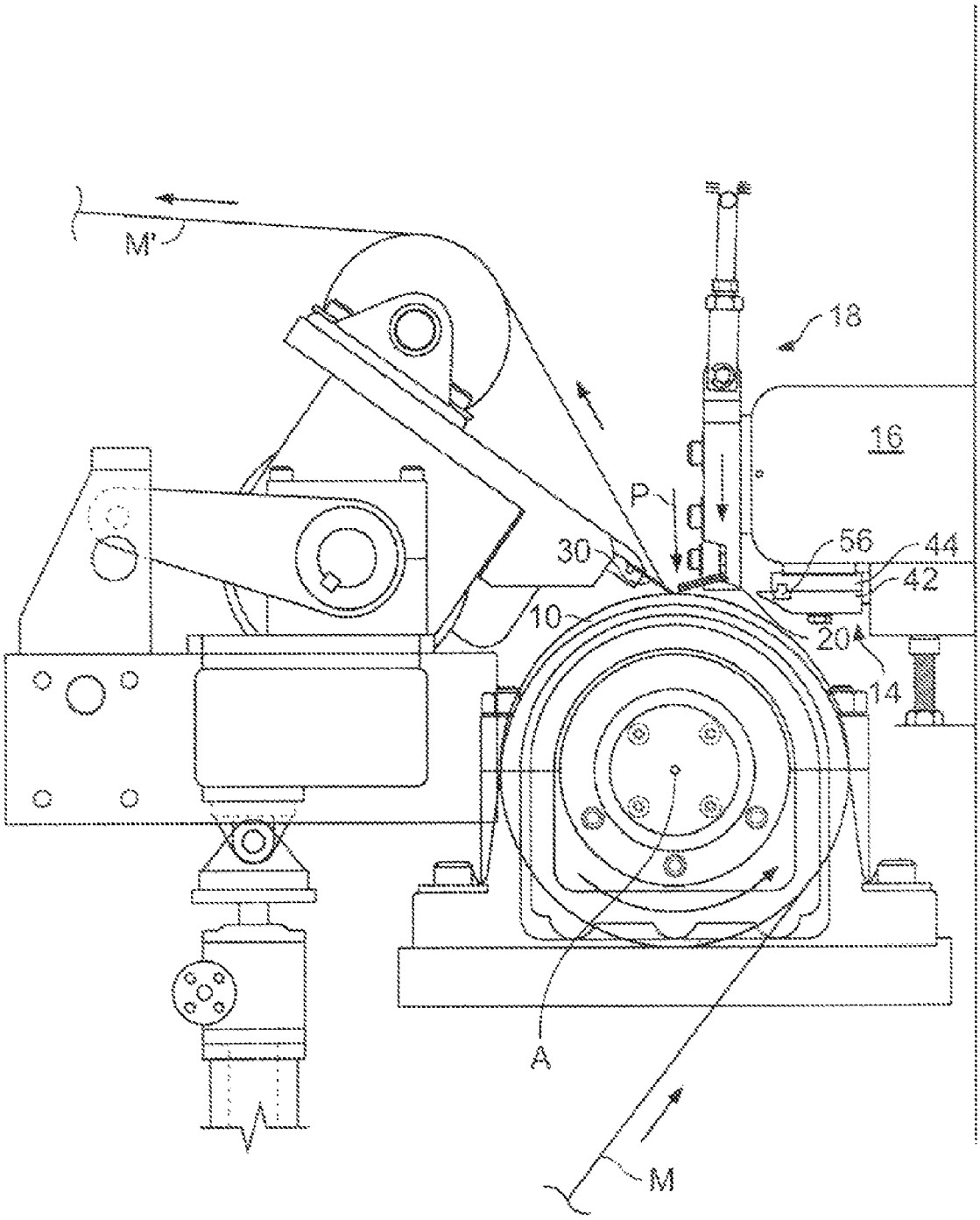
FIG. 1 (Prior Art)
FIG. 1 is a side view of a standard microcreper machine of the prior art, without its primary assembly in place.

FIG. 1 shows a standard one roll microcreper machine of the type employing a retarder blade. The machine is shown with its standard primary pressing and flexible retarder assembly removed. This microcreper is commercially available from Micrex Corporation, Walpole, Mass., USA. It is similar to the version of the machine shown in U.S. Pat. No. 4,717,329, but has a holder for the primary and retarder pressing assembly into which the rear margin of the primary assembly is slid endwise in accordance with U.S. Pat. No. 5,666,703. The original version of this type of microcreper is shown in U.S. Pat. No. 3,260,778. While also similar to the standard microcreper of FIG. 1, it employed a pressure clamp to secure the rear margin of the primary pressing assembly. Each of these patents is referred to, and in jurisdictions where permitted, is incorporated herein by reference, with regard to structure and operation of the primary pressing and retarding assembly.

Figure 2:
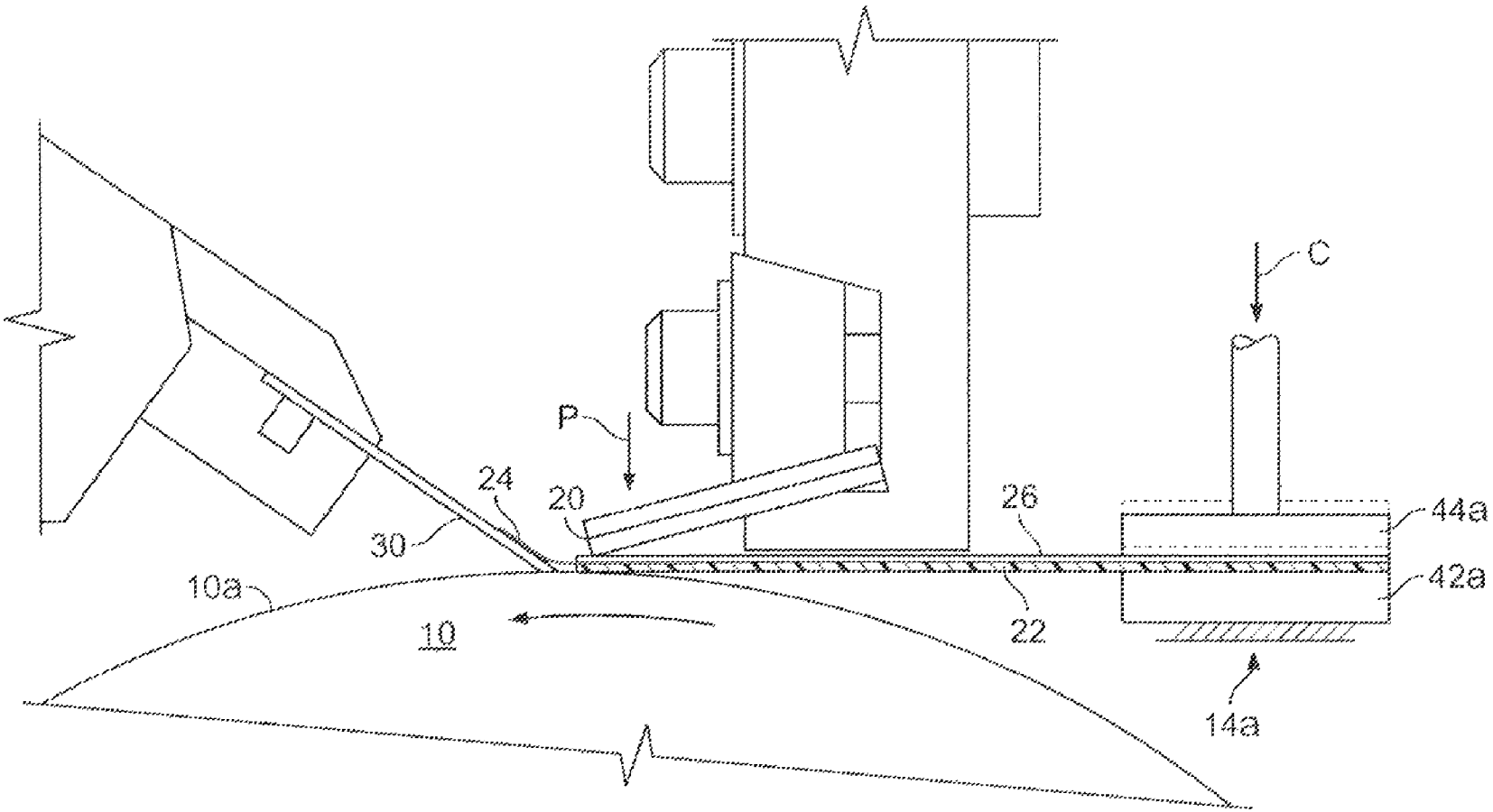
FIG. 2 is a magnified view of operative parts of a microcreper that employs a primary assembly having a thermoplastic primary member, the assembly held by a holder in the form of a pressure clamp, shown diagrammatically.

Referring to the present FIG. 1, a driven roll 10, of 72 inches length in the cross-machine direction, has an outer cylindrical gripping surface 10*a*, FIG. 2, for mechanically engaging the surface of the flexible web material to be treated. For instance, the gripping surface 10*a* may be defined by fine silicon carbide particles applied to a steel roll by plasma coating. This gripping surface receives a continuous length of predetermined flexible sheet material (web material) M of selected width, up to 72 inches. Following microcreping, the treated material, M', is led away from the machine. A holder 14 for the primary pressing assembly is carried on support member 16. The holder is constructed of lower and upper members, 42 and 44, respectively. These extend in the cross-machine direction, i.e., across the width of the machine. A rear margin of the primary pressing and flexible retarder assembly is constructed to be held between members 42 and 44. The primary pressing and retarder assembly then projects in cantilever fashion in the direction of travel of the material M, to a position under a pressure device 18. Pressure device 18 is constructed to apply downward force to shoe 20. The shoe in turn applies downward force, arrow P, to a narrow region across the full operating width of the primary member of the assembly. A retarder blade member 30 also extends across the full operating width. It is positioned to oppose forward thrust of driven material M while cooperating with a sheet-form confining member 24 ("flexible retarder") on the opposite side of material M to define an extrusion passage for the treated material, FIG. 2. The retarder blade 30 and the opposed confining retarding member 24 continuously slippably, i.e. freely, engage the opposite faces of the material M. The material is confined in the transition zone at the end of the primary member. Movement of the microcreped material M' is retarded by extrusion effects due to cooperation of the retarding and the confining surfaces slippably pressing against the opposite sides of the material. As is standard with one roll microcrepers, material M, driven forward by the gripping surface 10*a* of roll 10 (without adhesion to the roll), is microcreped (dry microcreped) in the small transition zone between the pressure shoe 20 and the extrusion passage defined by the retarder members 30 and 24. The lower temperature limit of operation of microcreping depends upon the level of temperature needed to heat-set the microcreped material (i.e. the temperature needed to remove old memory from the material and allow the new microcreped configuration to be retained by the material when the material cools). The maximum temperature at which desired treatment results may still be obtained, without unwanted melting or development of harshness of feel and the like or undue wear on the machine, depends upon the character of the web material and the nature of the desired treatment. For instance, undesirable melting of surface fibers of polyolefin fibers occurs at a lower temperature than for surface fibers of nylon. Melting and reshaping of the fibers can produce unwanted stiffness to the material. The top speed of operation is typically set for such materials by the level of frictional heating of the machine surfaces, which typically increases with speed of the web through the machine. (And indeed can become very high. Temperatures as high as 700° F. as a result of frictional heating and working of the material have been recorded in normal microcreping using conventional steel parts).

FIG. 2 and the remaining figures show examples of new microcreping cavities formed totally or in part of special plastic, preferably thermoplastic.

The examples of FIGS. 2 and 2A-2C employ sheet-form pressing members held by a clamping arrangement, similar to the technique employed in the original microcreper of U.S. Pat. No. 3,260,778. The examples of the remaining figures employ the holder of FIG. 1 into which the primary pressing assembly is slid endwise.

Figure 2A:
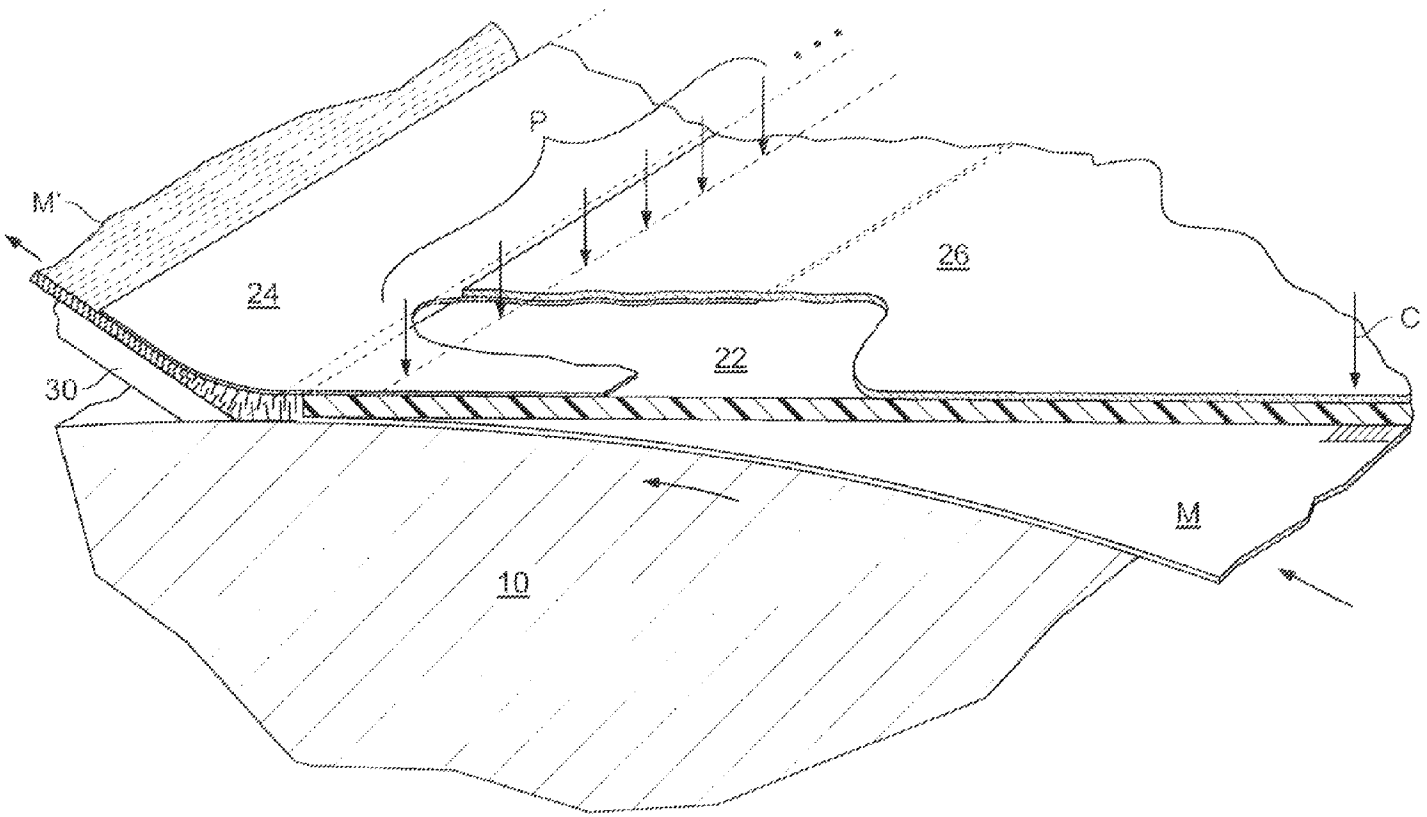
FIG. 2A is a diagrammatic, perspective view, on magnified scale, of the operative portion of the machine of FIG. 2, some parts being shown in cross-section, and with portions broken away for ease of illustration.

Referring to FIGS. 2 and 2A, the key feature is the plastic portion of primary member 22 that lies directly under shoe 20. The lower face is pressed against the outer face of traveling material M, FIG. 2A in response to the concentrated line of pressure P applied by shoe 20. This presses the inner face of material M into driven engagement with the gripping surface of roll 10. For primary member 22 the plastic is selected to be friction- and wear-compatible with the surface of the predetermined web M and physically stable under the predetermined operating conditions selected to perform the function of the member. Preferably the plastic has a wear coefficient less than about 100 under the test ASTM G-65 (avoiding undue wear such as that observed with Teflon coatings). Preferably it has a coefficient of friction of about 0.15 or less under the test ASTM D-1894. Preferably the plastic is a thermoplastic having all of these properties. In presently preferred forms the plastic of primary member 22 consists substantially of nylon, polyetheretherketone (PEEK) or ultrahigh molecular weight polyethylene and copolymers and compatible blends in which one or more of the foregoing is constituent. Discrete members formed of other resins are also operable depending on the conditions of use. An example of candidate materials in relatively low-abrasion applications is self-supporting grades of copolymers of ethylene and tetrafluoroethylene, e.g. in self-supporting sheet or plate form.

In the example of FIGS. 2 and 2A, the plastic primary member, in present preferred implementation, a thermoplastic primary member, is of extended sheet form and is coextensively backed (supported) by an overlying backing member 26 of cold rolled steel. Both extend across the operative width of the machine and are held stationary at their rear margins. In this example the plastic primary member is preferably greater than about 0.040 inch thick, preferably between about 1/16 and 1/8 inch (0.0625 inch and 0.125 inch) in thickness. The cross-machine, rear margins of the sheet members of corresponding extent are gripped and secured together by a stationary clamp 14*a*, shown diagrammatically. Clamp 14A is activated in the direction of the arrow C by a pneumatic piston, not shown. By firmly clamping the rear margins, the primary member 22 and backing member 26 remain stationary when the primary member is subjected to forward drag force by the traveling material slipping under it. The primary member resists the distorting tendencies of longitudinal tension applied by drag of the traveling sheet material and of the orthogonal face-wise compression applied by the pressing device. The mass at the drive region provided by the thickness of this plastic primary member, preferably under most conditions of use, greater than about 0.40 inch, absorbs and spreads the forces in such manner that the plastic does not warp or buckle in the cross-machine direction nor distort or extrude forwardly from beneath the pressure shoe 20. Thus under constant temperature and speed conditions, it is found that the treatment geometry can be constant throughout the width of the machine and throughout the processing of a supply roll of the flexible sheet material M.

In the example of FIGS. 2 and 2A, the rear margin of a flexible steel confining member (flexible retarder) 24 is inserted between the forward margins of the plastic primary member 22 and the overlying backer member 26 Member 24 then extends forward in position to be deflected by retarder blade member 30 to the upwardly angled form shown. In position it engages and presses against the side of the material as it emerges from under the primary member 22 while the material is slippably engaged on the opposite side by the retarder blade 30, establishing conditions for retarding by an extrusion effect.

In respect of differential thermal expansion of the plastic primary member 22 and metal parts with which it is associated, special steps are found that accommodate the effect and assure operability without geometric distortion.

The significant difference in the coefficient of thermal expansion of the plastic primary member and the backing member 24 to which it is clamped might appear to those of ordinary skill to prevent suitable operation due to danger of warping and unevenness of the treatment surfaces, but it is found to be accommodated by taking special steps described later herein.

In respect of selection of the plastic, in the special case of the traveling sheet material M to be microcreped being substantially comprised of a polyolefin, it is found advantageous in certain instances, for the primary wear member 22 also to be comprised substantially of a polyolefin. Ultra high molecular weight polyethylene is preferred.

Indeed for most flexible sheet materials, when the predetermined conditions of treatment include operating at temperature under about 220 F, the primary member, in the form of a wear member, is presently preferred to be of ultra high molecular weight polyethylene resin. For temperature of treatment above about 220 F a thermoplastic capable of retaining its form at higher temperature is appropriate. For example, to treat materials formed of high temperature nylon the thermoplastic of the primary member may be polyetheretherketone (PEEK). For microcreping lower temperature nylons, the primary member may be nylon 6,6.

In cases where the outer face of material M carries ink printing or other substance that does not adhere well to material M, so that the substance is subject to migration (transfer), the plastic of primary member 22 is selected to have transfer-resistant properties in respect of the migratory substance. Preferably, for treating a material M carrying such a migratory substance, the wear member is a plastic filled with an adhesion-resistant filler selected to resist adhesion of the migratable substance. In important examples, the plastic is selected from the category of filled plastic bearing materials. For instance the material M is a polyethylene sheet material carrying ink printing that does not adhere well, and the plastic is an oil-filled nylon. In one example of treating building wrap material carrying migratory ink printing, it found useful to employ the oil-filled nylon in the comb roll version of the microcreper substantially in accordance with U.S. Pat. No. 4,090,385.

Importantly, it is also found that flexible sheet material comprised of wood pulp can be treated at desirable speeds without undue wear of the engaging surfaces. In those cases, the thermoplastic resin of the wear member is preferably ultra high molecular weight polyethylene. This is especially the case if the wood pulp contains abrasive fines, as is the case for recycled wood pulp. Speeds up to about 800 feet per minute and higher can be obtainable in some important instances.

Nylon, and especially nylon 6,6, or polyetheretherketone may also be useful where temperature of operation exceeds about 220 F.

It is found that the primary member of plastic in many instances may have a cross-machine extent greater than the width of the material being treated. Contact of a member of ultra high molecular weight polyethylene with the roll surface has been found to produce little wear on either member, a result quite different from prior primary members formed of steel with or without a Teflon coating. As a result, it becomes unnecessary to precisely match the cross-machine length of the primary member with the width of the material being treated. This makes set-up of the machine simple and capable of being performed by workers having less skill than previously required.

In one case, during initial set up, the machine and primary assembly with the plastic primary member are warmed to running temperature before final clamping of the primary assembly. For example, when commencing a production run, it is common to run the machine slowly before advancing to a higher, and often, to a still higher speed. The amount of frictional heat generated at the primary member is dependent upon the speed with which the material passes through the machine. After a speed increase the temperature of the primary member rises. Under this condition, it has been found useful to stop the machine, release clamping pressure to permit the heated primary member to expand, and reclamp and resume operation as soon as possible. This procedure may be repeated with step-wise increase in speed until the machine reaches operating temperature.

It is also found advantageous, prior to installation, to preheat the primary member and its backing member in an oven or by placing it near a heated object such as the heated drive roll to produce their differential thermal expansion. While still hot, the assembly is mounted and clamped into running position on the machine. The machine is then operated at this temperature to perform its microcreping.

Another technique that enables automatic accommodation of thermal expansion will be described later herein in respect of an expansion-tolerant slideable mounting of the plastic primary member.

Figure 2B:
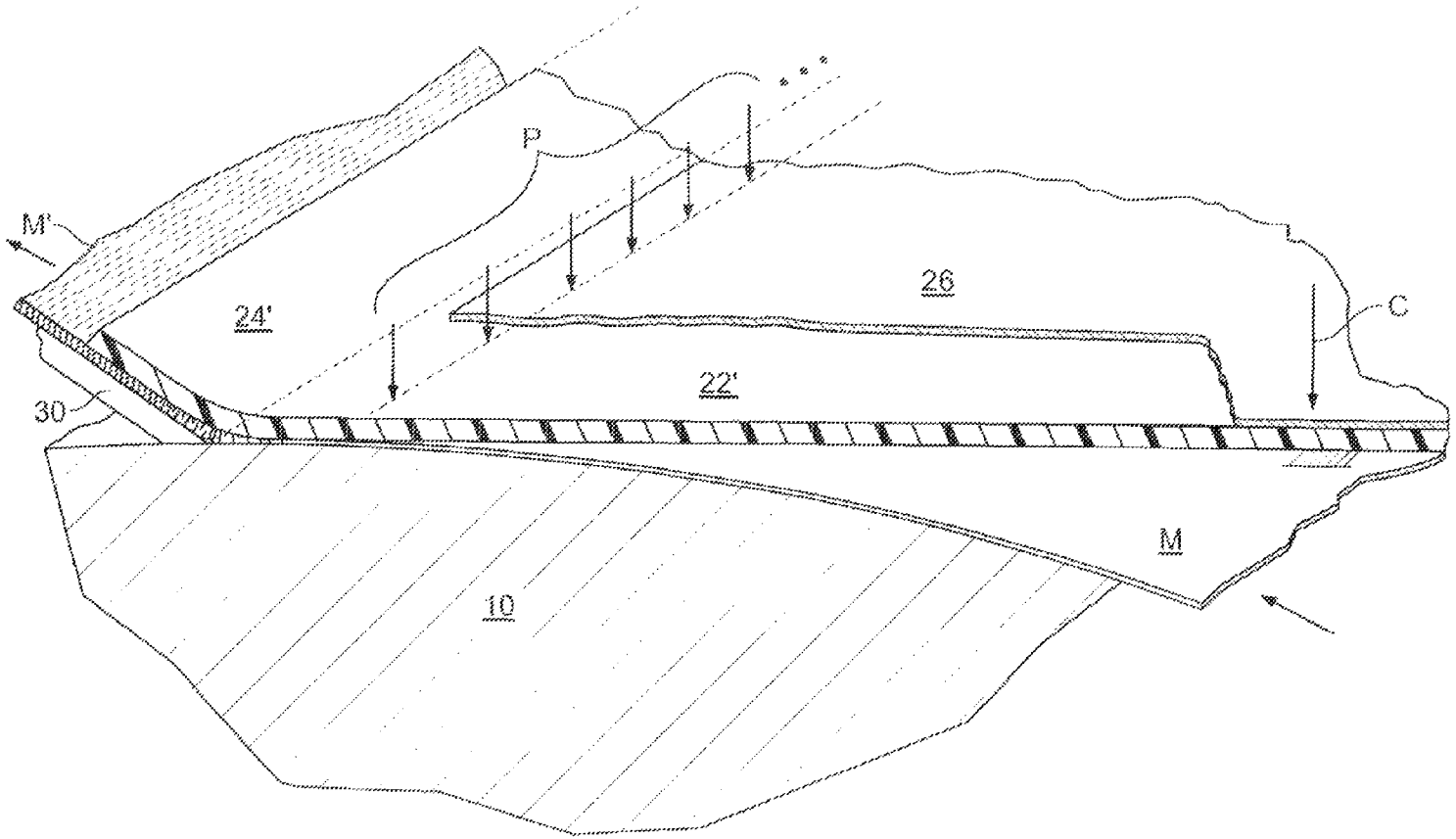
FIGS. 2B and 2C are diagrammatic, perspective views, similar to FIG. 2A, employing other plastic members bounding a microcreper treatment cavity.

The example of FIG. 2B differs from that of FIGS. 2 and 2A in that, in place of the flexible confining member 24 of spring steel, a forward extension 24' of the plastic primary member 22' extends beyond the forward edge of backing member 26. It is deflected to the position shown by retarder member 30. After a period of operation, while deflected to this position, a permanent bend approaching this shape may be achieved. In this shape the confining member 24' confines the material M in the transition zone and cooperates with the retarder blade 30 to apply retarding force by extrusion effect to the microcreped material M' as it leaves the microcreping region.

Specifically, extension 24' converges with the blade 30, and then parallels it to form a longitudinal retarder passage through which the treated material is forced to extrude. It is found that the plastic resin selected for the primary member can perform as the retarder extension 24'. While shown at the full thickness of the primary member in FIG. 2B the concept is not limited to that. Where a more delicate retarding pressure is desired or where an increased treatment space is desired in that transition zone, the extension 24' may be made thinner, for instance, by omission of material as appropriate from its upper or lower side.

Figure 2C:
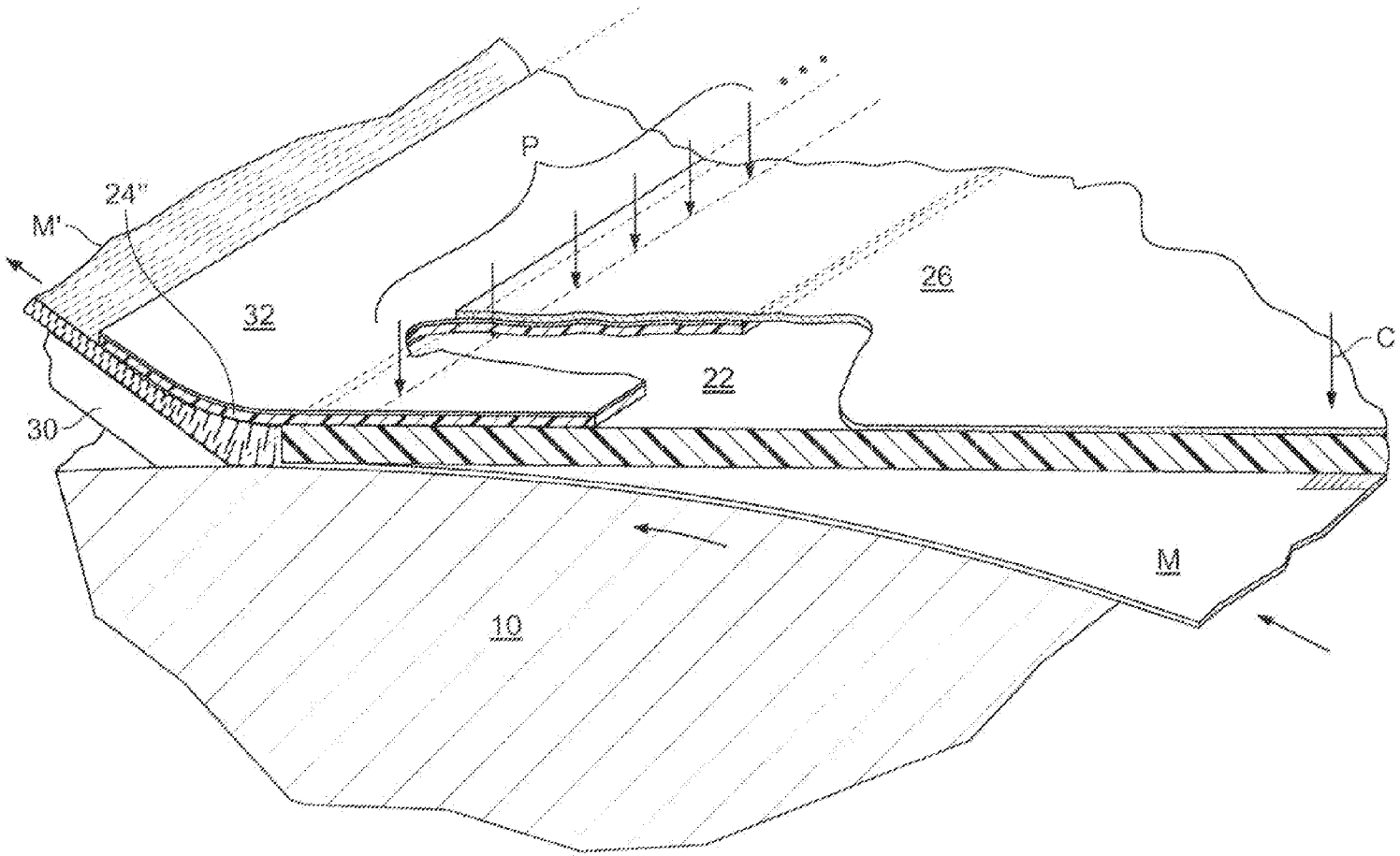

The implementation of FIG. 2C employs a primary member 22 of plastic selected to have properties corresponding to the properties described previously for the primary member 22 of FIG. 2A, while the confining member 24" of sheet form is also a plastic selected to be friction- and wear-compatible with the surface of the predetermined web M and physically stable under the predetermined operating conditions selected to perform the function of the member. Preferably the plastic has a wear coefficient less than about 100 under the test ASTM G-65 (avoiding undue wear such as that observed with Teflon coatings). Preferably it has a coefficient of friction of about 0.15 or less under the test ASTM D-1894. Preferably the plastic is a thermoplastic having all of these properties. In presently preferred forms the plastic of primary member 22 consists substantially of nylon, polyetheretherketone (PEEK) or ultrahigh molecular weight polyethylene and copolymers and compatible blends in which one or more of the foregoing is constituent. Discrete members formed of other resins are also operable depending on the conditions of use. An example of a candidate material in relatively low-abrasion application is self-supporting grades of copolymers of ethylene and tetrafluoroethylene e.g. in self-supporting sheet or plate form. In this case the plastic resin can be different from the resin employed for the primary member 22, and its physical dimensions may be different. For instance, as shown the confining member 24" may be substantially thinner than the primary member and where warranted may be supported by a further member engaged with it. In the implementation of FIG. 2C, plastic member 24" is supported by a thin backing member 32 which is coextensive with member 24" and is gripped with it at their rearward margins between the primary member 22 and its backing 26. In useful implementations the thickness of the confining member 24" is between about 0.005 inch and 0.015 inch.

The blade member 30 which forms the opposite side of the retarding extrusion passage may also be advantageously formed as a plate member of plastic selected to be friction- and wear-compatible with the surface of the predetermined web M and physically stable under the predetermined operating conditions selected to perform the function of the member. Preferably the plastic has a wear coefficient less than about 100 under the test ASTM G-65 (avoiding undue wear such as that observed with Teflon coatings). Preferably it has a coefficient of friction of about 0.15 or less under the test ASTM D-1894. Preferably the plastic is a thermoplastic having all of these properties. In presently preferred forms the plastic of primary member 22 consists substantially of nylon, polyetheretherketone (PEEK) or ultrahigh molecular weight polyethylene and copolymers and compatible blends in which one or more of the foregoing is a constituent. Discrete members formed of other resins are also operable depending on the conditions of use. An example of a candidate material in relatively low-abrasion application is self-supporting grades of copolymers of ethylene and tetrafluoroethylene e.g. in self-supporting sheet or plate form. In cases in which the material being treated has a thin coating or film the integrity of which is important (for instance as a liquid barrier) it has been found that fiber reinforcement within the resin can cause pinhole damage, and that it is advantageous to employ resin free of fiber-reinforcement, for instance, ultra high molecular weight polyethylene, although the plastic may contain powdery fillers, e.g. fine graphite powder filler.

In a recent demonstration, microcreping was begun with all 3 stationary surfaces defining a bladed microcreper cavity formed as separate parts of plastic selected in the manner described above. Over time the plastic primary member and the plastic retarder blade were removed and replaced with metal parts leaving only the containing, flexible retarder member 24" of plastic, see FIG. 2C. It was still found possible to satisfactorily run the microcreping process on a web of polypropylene fibers at speeds higher than normally obtained with a microcreping cavity formed by all metal parts.

This improved operation is believed to be explainable as follows. Though the pressure on the confining member 24" is much lower than on the primary member 22, the area of its surface engagement is much larger and the time for heating the web material is much longer than is the case for the primary member. Thus the confining member provides an area of heat generation by friction.

In general, frictional heating of the web material is an additive phenomenon. By reducing the heat added in the region of the flexible retarder member 24", the material is heated less in total, than would be the case if the member 24" were of metal.

Furthermore a flexible retarder member 24", if of metal, with rear margin sandwiched over the pressure region of a metal primary member 22, i.e. in intimate face-to-face thermal contact with the metal primary member, can act as a heat conductor from the primary member to the extended area of the flexible retarder, and in the region of engagement with the material, the member 24" can cause heating of the web by conduction from the remote heat source. But, as observed in the demonstration just described, although using a primary member 22 of metal that generates frictional heat, by making the confining member 24" of plastic of much lower thermal conductibility than metal, the heat from the primary member heat source is defeated from being transferred to heat the material over the much more extended length. In other words, the plastic flexible retarder member 24A shortens the duration any increment of the traveling web material is exposed to elevated temperature, so that less total heat is transferred to that web increment. For these reasons, it is found possible to run faster with only the confining member 24" being the plastic, than with an all metal treatment cavity. The concept of employing plastic in the pressing assembly, in its broader aspects, is therefore not limited to the primary member being required to be of the plastic, but, when viewed broadly, includes situations in which the primary member is plastic or the one or both of the retarder members is of plastic. In all of these situations, the heating chain is broken, in comparison to an all metal cavity, reducing the total amount of heat transferred to the web material at a given speed, and hence, while obtaining acceptable product, allowing the material to be run at faster, hence more economical, speeds. To emphasize: (1) Increasing speed for any given set up of the machine increases friction heating during microcreping. With the primary member formed of plastic, using a metal confining member or plastic confining member, heat production is reduced at the primary line of pressure concentration, where friction heating per unit area is highest. That decreases the total heat transferred to the web material per unit of speed, and hence, while obtaining acceptable product permits higher speed operation, in comparison to an all metal microcreping cavity. (2) On the other hand, with one or both of retarder members of the plastic, with primary member of metal or a suitable plastic, (a) heat generated by friction heating at the extrusion retarding passage is lower (much lower pressure of the faces of the material than at the primary member, but much longer duration of exposure to the traveling web material for imparting friction heat to the material), and (b) in the cases of a flexible retarder member of plastic, no heat or less heat is transferred by the retarding member from the primary region, either because not much heat has been generated at the primary member in the case of its also being of plastic, or, if the primary member is of metal, then because of low heat conductivity of the flexible retarding member from a hot metal primary member. Again, then, with the flexible confining retarding member or both of the retarding members of the plastic, the heat transferred to the web material per unit of speed is reduced, so that speed of treatment can be increased while obtaining acceptable product, in comparison to an all metal microcreper cavity. It is usually the case, among the conditions mentioned, that highest speeds are obtainable with the flexible retarder member 24" and the primary member 22 both of the plastic, as illustrated in FIGS. 2B and 2C. An even higher increment of speed is obtainable in important instances by also making the retarder blade 30 of the plastic so that both sides of the extrusion retarding passage are of the plastic.

Selection of Plastic Resin in Respect of Friction and Wear

For selecting the optimum resin for the plastic member to be friction- and wear-compatible relative to a given flexible sheet material to be treated, a series of simple trials on a microcreper machine can be conducted on that material. The treatment effect, the maximum speed attainable while obtaining the desired treatment effect, the temperature rise due to frictional heating and the amount of substance of the primary member that is worn away over time should be observed and compared. However, even with mere reference to published wear, friction and temperature data for plastic resins, a good choice can typically be made for the plastic resin in light of the present disclosure, or a small number of potential candidates can be compiled from published data, from which a serviceable material can be chosen by brief comparative trial.

Selection of Thermoplastic Resin in Respect of Treating Materials Bearing Ink or Other Substances that do not Adhere Well A test for whether a problem exists can simply be by a trial run.

Building material such as Tyvek™, of DuPont, of polyethylene (PE), for instance, has printing on it. Polyethylene is difficult for ink to adhere to. For instance, scratching a sample with a knife shows that the ink does not adhere well. A region of adherent ink build-up on cavity surfaces in registry with the place where the printing occurs can be observed as can the interference with the microcreping process that the accumulation causes.

A plastic can be chosen for parts of the microcreper cavity to combat accumulation on the cavity parts of a migratory ingredient of the web being compressively treated, or to render the surface easy to clean. In general, the plastic should reduce adhesion of the migratory ingredient, chosen with respect to the particular migratory ingredient carried by the web being treated to decrease a tendency for the ingredient to adhere to a surface of the microcreper cavity. In particular, plastic materials normally sold for bearings, such as filled nylons, are found to be useful. One mode of implementation has been to use oil-filled plastic, the filler being effective to combat adhesion and build up of printed ink. Filled Nylon 6,6 is suitable, for instance, in respect of some inks on polyethylene. A trial conducted with selected candidate materials can be conducted to select the most appropriate candidate.

For instance, this will lead to a suitable filled plastic for microcreper cavity plastic parts (primary, flex or retarder blade) to decrease ink build-up when microcreping polyethylene material bearing ink markings such as the building wrap material Tyvek™, or other polyethylene web materials, an example being high quality shopping bag material.

Treatment of Polyolefin

For expanding the range of materials of polyolefin to be susceptible to being commercially microcreped, it is conceived to employ a primary member also of polyolefin. Such like-materials have low dynamic coefficient of friction relative to each other, and hence will not over-heat the material being treated. In particular, it is conceived that resins of high molecular weight are preferable as having useful wear resistance. Resins of ultra high molecular weight polyolefin are presently preferred.

The ultra high molecular weight polyethylene resin presently considered best is that available under the trademark Tivar H.O.T. (trademark of Poly Hi Solidur, Inc., Fort Wayne Ind., USA.). As published by Crown Plastics (www.crown-plastics.com/tivar-hot-specs.htm.), this material has a dry sand wheel wear value of 90 under test ASTM G-65 (in which steel has value of 100), dynamic friction under test ASTM D-1894 of 0.12 and maximum operating temperature of 275 F (135 C). Its coefficient of thermal expansion under ASTM D-696 is 0.00011 per degree F. (0.0002 per degree C.).

In testing a number of traveling flexible sheet materials of polypropylene and polyethylene, a primary member comprised of this ultra high molecular weight polyethylene was employed. It was found to provide excellent results because of its exceptionally elevated degree of toughness combined with its low friction quality relative to the polypropylene and polyethylene sheet materials. Downward pressure of the primary member on the traveling sheet material at pressure and production speed suitable for many microcrepe treatments was found not to frictionally heat the traveling sheet material beyond treatment temperature range. Though the material of the primary member has a relatively low softening temperature, the small amount of frictional heat generated did not harm it. Thus ultra high molecular weight polyethylene is confirmed to be operable for low temperature fiber- and film-forming resins such as polypropylene and polyethylene.

In one example, a small-scale laboratory microcreper was used in comparison trials between steel coated with fluorocarbon and Tyvar H.O.T. thermoplastic primary members. In the trials, a polypropylene spun bond nonwoven fabric was microcreped. Whereas, for the given treatment, using the steel primary member, the fabric could not be properly processed at speed above 100 feet per minute, with the thermoplastic primary member, speeds between 140 and 150 feet per minute were successfully employed, and higher speeds, though not employed, appeared readily possible. There was no noticeable wear of the thermoplastic primary member. Such increase in productivity, of 40% or more, is extremely important.

Other comparisons were made in which the microcreping produced high levels of longitudinal compaction (for example, 60%) in webs of polypropylene. It was observed that the maximum speed achievable, before unacceptable melting or stiffening of the treated product occurred was often 100%, 200% or considerably more, when employing a primary member of Tivar H.O.T. ultra high molecular weight polyethylene, than when employing a primary member of steel coated with fluorocarbon (Dupont's Teflon).

A production demonstration was also performed using the Tyvar H.O.T. primary member and the full-size production microcreper of FIG. 1. Spun bond nonwoven webs of polypropylene of varying weights and widths were microcreped for the purpose of introducing a high level of longitudinal compaction and stretchiness while maintaining softness (without "crispness" or harshness to the touch). The microcreping was successfully conducted at speeds up to 200 feet per minute, employing a primary member of 0.062 inch thickness Tyvar H.O.T. ultra high molecular weight polyethylene. Pressures P of 10 to 40 pounds per inch of pressure shoe length were employed. A primary member extending the full width of the machine was employed, a width exceeding the width of some of the materials being treated. Thus, end portions of the primary member at times rode on the gripping surface of the roll. Large rolls of various widths of the polypropylene material were produced having the desired characteristics, using the same primary member. Again, there was no noticeable wear of the thermoplastic primary member.

Products of Wood Pulp

For paper, i.e. Kraft paper made of wood pulp which inherently has mineral fines, and even more so, recycled Kraft paper having additional abrasive contaminants, the web is typically much more abrasive than is the case with woven or nonwoven web or film materials formed completely of synthetic resin. To some extent, abrasive properties similar to paper are also found with other flexible sheet-form materials that have a substantial wood pulp content. An example is nonwoven wipe material that contains wood pulp to provide absorbency, in a composite that includes synthetic fibers to contribute structural strength. In many instances, neither hardened steel such as invar, blue spring steel, nor stainless steel, with or without fluorocarbon coatings, has been found to withstand abrasion sufficiently to enable acceptable commercial microcreping of such materials.

In many cases for treating sheet material comprised of wood pulp, it is found that the primary member may be usefully formed of ultra high molecular weight polyethylene. It is found operable at relatively high speeds, despite its low melting temperature, because of low frictional heating, and it demonstrates a long wear life. Because of its low temperature of operation, it is also useful to microcrepe paper coated with thermoplastic that can be damaged if the temperature rises too high and to microcrepe nonwoven composites that contain polyolefin fibers as well as wood pulp fibers.

In an example, Kraft paper having a polyethylene coating was microcreped to render the material stretchable and conformable about objects to be wrapped. A primary member of Tivar H.O.T. ultra high molecular weight polyethylene was used. The composite material was run with the paper side up, engaged by the primary member employing speeds up to 200 feet per minute. As before, a primary member extending the full width of the machine was employed, a width exceeding the width of some of the materials being treated, so that end portions of the primary member at times rode on the gripping surface of the roll. Several days of running verified the long life of the primary member.

In other cases, it is contemplated that a primary member of ultra high molecular weight thermoplastic can be employed at the much higher speeds, 800 feet per minute and higher, speeds which are demanded to be economically viable for many products formed of wood pulp, such as flexible material intended to be formed into disposable wipes.

Other Thermoplastic Materials for the Primary Member

While ultra high molecular weight polyethylene is the presently most preferred material for the primary member, other thermoplastics meet minimum requirements of combining improved wear resistance with sufficiently low friction properties. These are appropriate to use when the temperature of operation exceeds the operating limit of Tyvar H.O.T. Two materials in this category are nylon 6,6 and PEEK (polyetheretherketone).

According to MatWeb Material Property Data (www.matweb.com), nylon 6,6 has a wear factor (K) of 180, a coefficient of friction of 0.09 and a melting point in the range of 412-509 F (211-265 C). It is thus a high temperature, low friction material. It has wear properties, though not as good as some, still considerably superior to fluorocarbon coatings, and can be provided in durable sheet form of the required thickness of at least 0.040 inch for use as a microcreper primary member, as here described.

Regarding PEEK, (polyetheretherketone), according to the vendor Victrex plc (www.vitrex.com), it has a wear factor of about 200, a coefficient of friction of 0.25 and a melting point of 644 F, with a long term service temperature of 480 F. Where a microcreping process must be conducted at very high temperature, it may be employed as the thermoplastic material for the primary member.

High Temperature Microcreping of Fiber-Forming Resins

As previously mentioned, in the case of high temperature treatments, thermoplastic capable of retaining its form at high temperature is necessary. For microcreping high temperature nylons, for example, the present best choice for a thermoplastic primary member appears to be PEEK (polyetheretherketone) while for microcreping lower temperature grade nylons the best choice appears to be nylon 6,6, again taking advantage of the low friction coefficient between members of the same nylon category. As a point of information, it should be noted, for microcreping sheet materials comprised of high temperature resins where it is desired to heat the material during microcreping, e.g., to heat-set the effect, the specific problems are different than for other treatments. It is found that the low friction characteristic does not have to be exceedingly low because some heating of the sheet material is needed to bring it into its heat-set range; in part that heat can be contributed by frictional heating. A steel primary member can often be used in such instances to good effect, for instance with respect to sheets of polyester. If it is desired, instead, to use a primary member of thermoplastic, the resin of the primary member, to withstand treatment temperature, may be PEEK (polyetheretherketone) or nylon 6,6.

Other Plastics/Thickness of the Parts

The broad concept presented is to use plastic parts with low friction and high resistance to wear, the parts chosen to have sufficient rigidity to stand up to the conditions of use. Mylar has high friction and Delryn and carbon-filled epoxy have high wear against typical materials being microcreped, and are typically not suitable, for instance.

According to the broadest concept, it is not necessary for the parts to be "thermoplastic" (i.e. in some cases thermoset resins may be employed) or that the minimum thickness be 0.040 inch. There are some conditions in which the plastic primary part may be as thin as 0.0125 inch, the broadest concept being, with suitable friction and wear characteristics, as described, that the plastic material be selected to be stable under conditions of use (i.e. not extrude).

In General

At the various operating temperatures, it is found that there are thermoplastic resins that demonstrate resistance to wear better than Teflon coatings and still have sufficiently favorable friction qualities as to be useful in microcreping as when formed into the primary member of at least 0.040 inch thickness, and the other stationary members as described. In specifying preferred thermoplastics herein, we intend to cover these resins in blends, copolymers and members that contain reinforcement.

Mounting that Avoids Detrimental Effects of Thermal Expansion

In respect of special steps that avoid detrimental effects of thermal expansion of the plastic primary member it is also realized that a mounting of the member can be constructed that permits free cross-machine thermal expansion relative to its support while enabling effective load spreading on the plastic primary member and slideable assembly of it into a mounting. The technique to be described is useful with primary members made of thermoplastic, which will be used in the description of the following implementations.

In particular, construction of the machine to enable free thermal expansion of the thermoplastic primary member has great advantage. It enables quick and simple set-up of the machine without requiring great skill, and enables gradual increase of the speed of the machine to the highest practical operating speed in a sure way without increasing frictional-heat associated with speed change causing warping or buckling of the primary member.

Referring to the following embodiments, the primary member of plastic is of thickness greater than about 0.040 inch. Preferably it is a continuous sheet of uniform thickness between about 1/16 and 1/8 inch (0.0625 inch and 0.125 inch). The thermoplastic is selected to be friction- and wear-compatible with the surface of the predetermined traveling flexible sheet material, as described previously.

For permitting easy assembly and enabling thermal expansion of the thermoplastic primary member without disturbance of its geometry, the primary member defines a linear load-spreading surface which extends in the cross-machine direction and is directed in the direction of travel of flexible sheet material M. This surface is constructed to engage a corresponding portion of a restraint member to receive and spread resistance force that resists forward drag force applied by the traveling material under the primary member. Its form, as shown, provides a slideable guide for sliding assembly of the primary member with other parts while enabling its crosswise thermal expansion.

Figure 3:
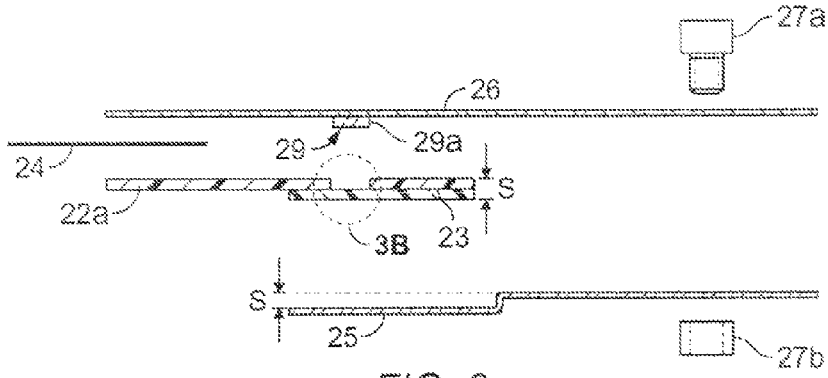
FIG. 3 is an exploded view in cross-section of the parts of another primary assembly, in this case the assembly being capable of being slid endwise into the holder of FIG. 1.
Figure 3A:
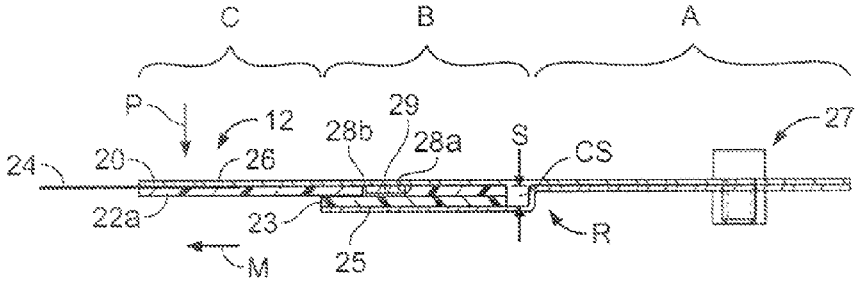
FIG. 3A is a side view of the assembled parts.
Figure 3B:
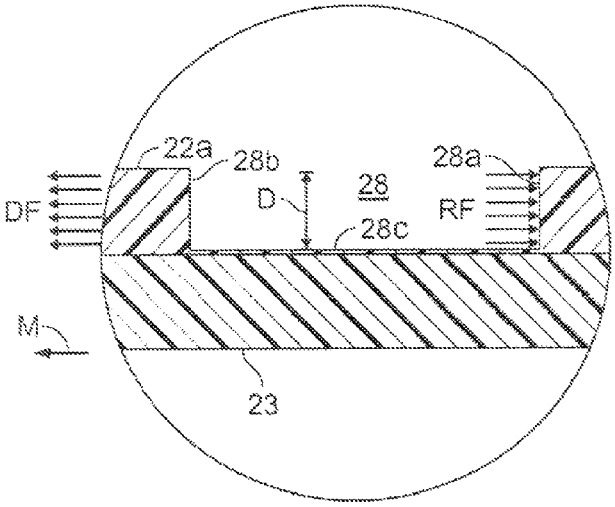
FIG. 3B is a greatly magnified view of the portion of FIG. 3 indicated by the circle in FIG. 3.
Figure 3C:
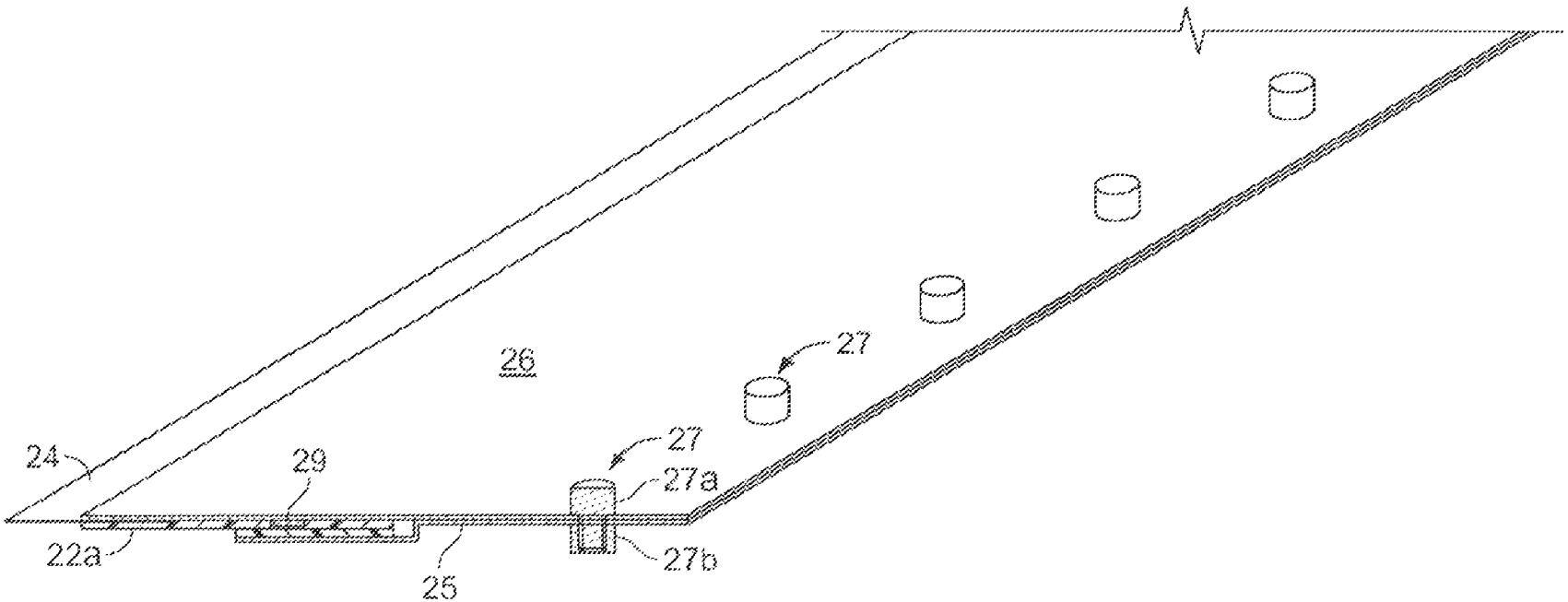
FIG. 3C is a cross-sectional, perspective view of this new primary assembly.
Figure 4:
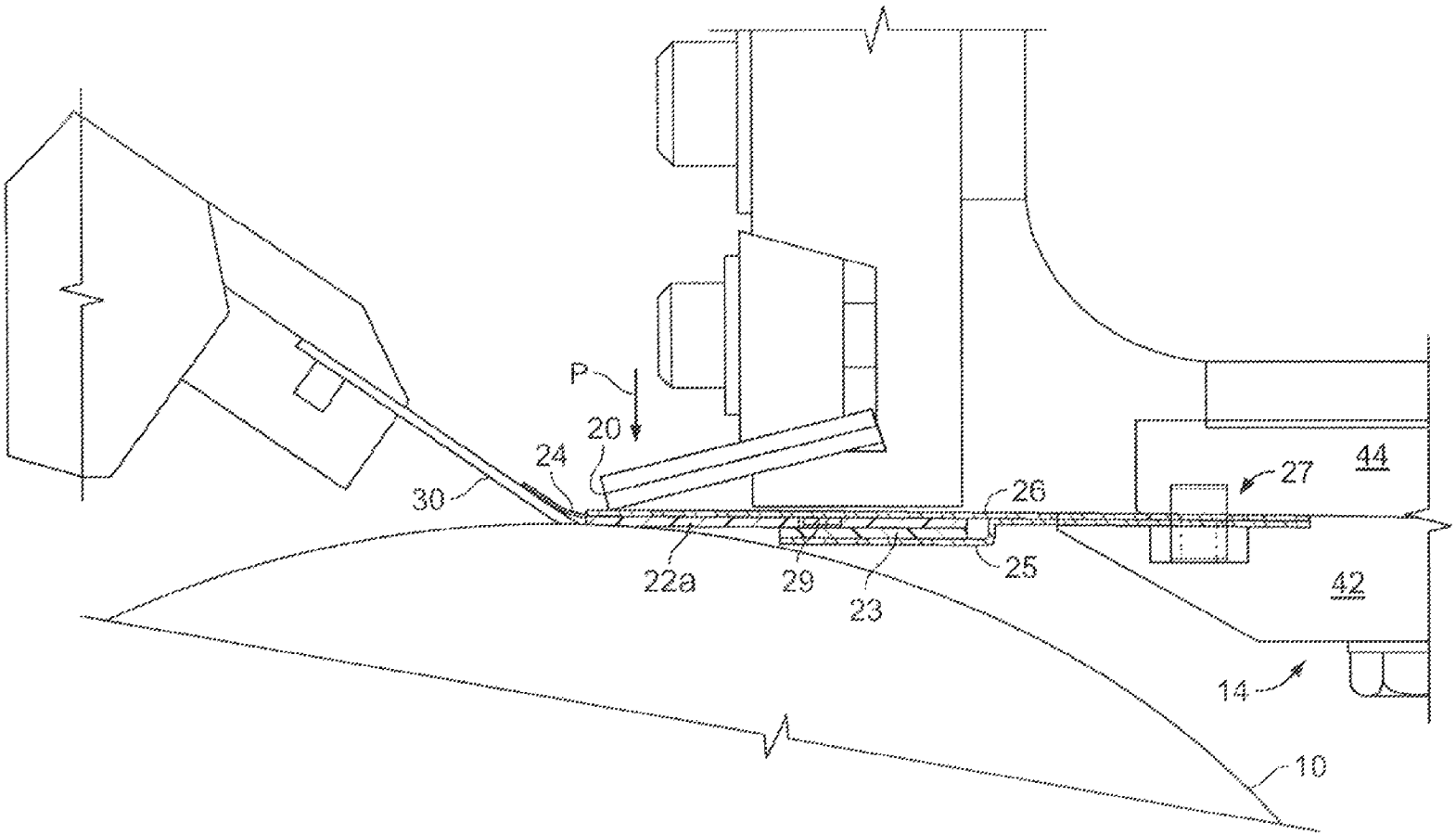
Figure 4A:
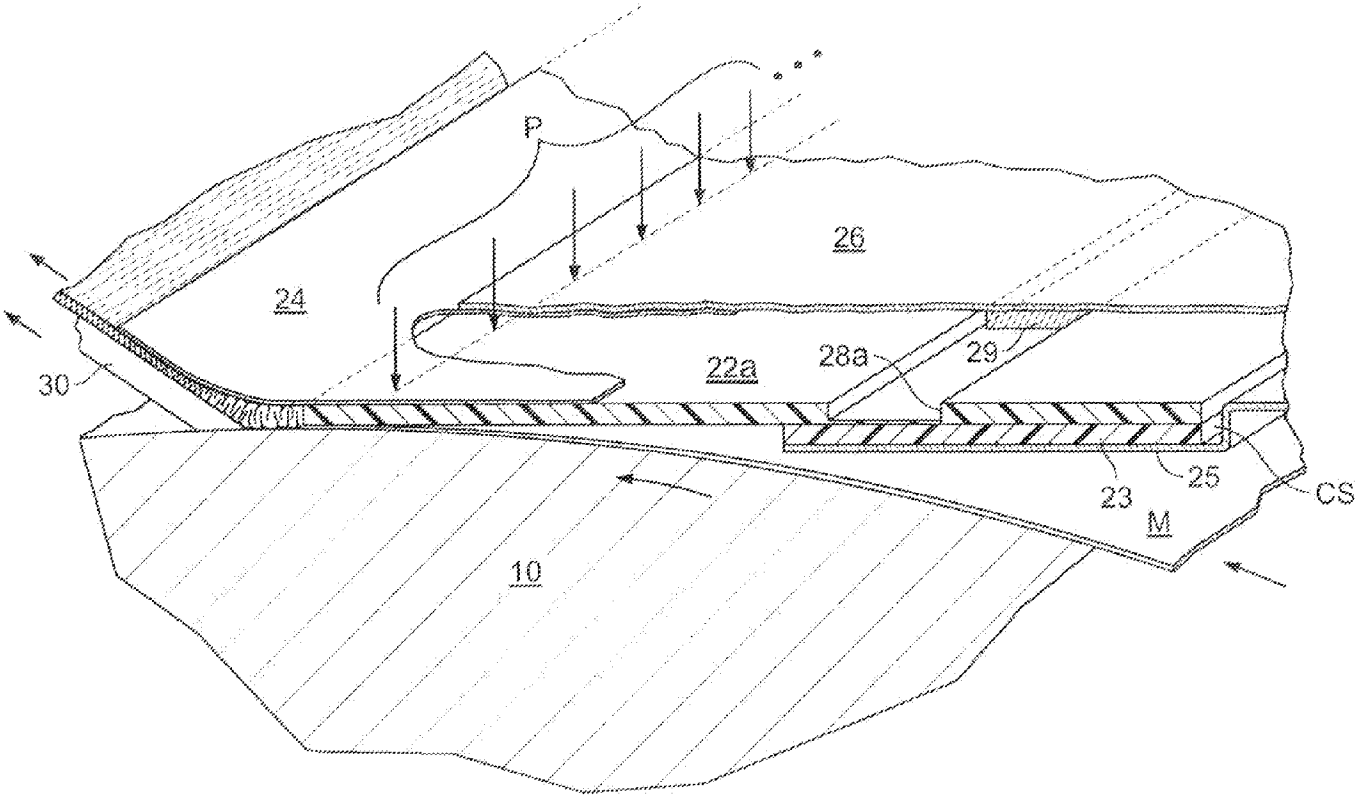
FIG. 4A is a diagrammatic, perspective view, on magnified scale, of the operative portion of the machine of FIG. 4, some parts being shown in cross-section, and with portions broken away.

In the example of FIGS. 3-3C and 4, a cross-machine groove 28 is formed in the upper surface of body of the thermoplastic primary member 22*a*, the trailing wall of the groove defining a linear load spreading surface 28*a*. Parallel surface 28*b* defines the forward side of the groove. Groove 28 is of depth D, at the bottom of which is wall 28*c*, constituting the remaining thickness of the sheet member 22*a*. In a preferred form, depth D is about 0.050 inch or greater. A secondary member 23 having a coefficient of thermal expansion similar to that of the primary member is joined at the bottom, to the rear portion of primary member 22*a*, FIG. 3A. This adds to thickness to facilitate mounting and strengthening. For instance, secondary member 23 is also of overall sheet-form of the same thermoplastic as primary member 22*a* and is strongly joined to the lower side of primary member 22*a* by an adhesive extending throughout the interface of the two members. Referring to FIG. 3B, in this way, member 23 shares the tension load produced by drag force RF on the forward portion, in one direction, and the oppositely directed restraint force RF applied to the rear portion of the primary member. Member 23 is foreshortened to avoid interference with pressing action of the primary member in the forward region.

The mounting for this primary member provides a load-spreading restraint surface that extends in the cross-machine direction and engages load-spreading surface 28*a* of the groove in thermoplastic member 22*a*. This enables distortion-free action of the primary member despite forward drag on its lower surface and concentrated orthogonal pressure P, FIG. 2A, applied to the thickness of this relatively soft thermoplastic member. By the engaged surfaces being linear, sliding of the thermoplastic member into its mounting during assembly is enabled. By the linear surfaces being parallel to the roll axis, the mounting permits cross-machine creep of the thermoplastic primary member relative to the members between which it is mounted, enabling thermal expansion and contraction of the primary member without constraint. Thus warping or other distortion of the thermoplastic material is avoided despite its considerable thermal expansion in a construction which enables fast set-up of the microcreping process.

In the example of FIGS. 3, 3C and 4, the features of load spreading, sliding assembly and thermal expansion of the mounting assembly are provided by lower and upper sheet metal mounting members, 25 and 26, of a cross-machine extent corresponding to that of the primary member 22*a*, each for instance of cold rolled steel of thickness between about 1/16 and 1/8 inch (0.0625 to 0.125 inch).

Rearward portions of the mounting members, region A, FIG. 3A, are held face-to face by a cross-machine series of fasteners 27, FIG. 3C, e.g. bolts 27*a* and engaged threaded nuts 27*b*. Fasteners 27 are sized to slide into slot 56 defined by mating members 42 and 44 of holder 14 to restrain the assembly from forward movement when material M slides under the primary member. Beyond holder 14, in region B, forward portions of the mounting members 25 and 26 are spaced apart uniform distance S to receive the primary member 22*a* and secondary member 23. In the example shown in FIGS. 3 and 3A, upper mounting member 26 is of continuous planar form in regions A and B. Lower mounting member 25, in bend region R, has successive right angle bends in opposite directions, so that lower member 25 in region B is parallel to upper member 26 but spaced apart uniform distance S. Lower member 25 terminates at the end of region B, preceding the shoe 20, while upper member 26 extends through region C to a forward end slightly forward of the pressure point P of shoe 20. In one preferred form, the dimensions of regions A, B and C are, respectively, about 2 inch, 1 1/8 inch (1.125 in), and 1 inch in the machine direction.

In this example, to define linear restraint surface 29*a*, a steel bar member 29 extends across the width of the machine. It has a rectangular cross-section in the machine direction and is joined to the under surface of upper member 26 as by spot welding. It is of depth slightly less than depth D of groove 28 and of width slightly less than the width of the groove.

As shown in FIGS. 3A and 3C, when assembled and inserted into the holder 14 of FIG. 4, the fasteners 27 hold the upper and lower metal members face-to-face. The thermoplastic sheet member 22*a* and secondary member 23 are slideably inserted endwise into the space between the metal members 25, 26, with the groove of the thermoplastic primary member engaged about bar 29, upper face of primary member 22*a* engaged with clearance relative to the lower face of upper member 26 and the lower face of the secondary member 23 thus loosely engaged by the upper surface of lower mounting member 25. A clearance space CS is provided between the rear end of the thermoplastic members and the metal members. Bar 29 has its rearwardly-directed linear restraint surface 29*a* exposed to slideably engage the forwardly-directed surface 28*a* of the thermoplastic groove. Thus it resists forward drag exerted by the traveling flexible sheet material against the thermoplastic primary member, but permits independent thermal expansion and contraction, in the cross-machine direction, of the primary member.

Here again, the thickness greater than about 0.040 inch of the relatively soft thermoplastic primary member 22A in the pressure region is found to resist distorting tendencies of tension applied by drag of the traveling material and the orthogonal face-wise compression applied by the pressing device. Thus the critical geometry of the drive and treatment regions can be maintained constant throughout the width of the machine, and over the operating period.

In the example of FIGS. 3A-3C and FIG. 4, the machine direction extent of the upper member 26 may be 4.125 inch and the other dimensions areas as proportionately shown in FIG. 3C.

Figure 5:
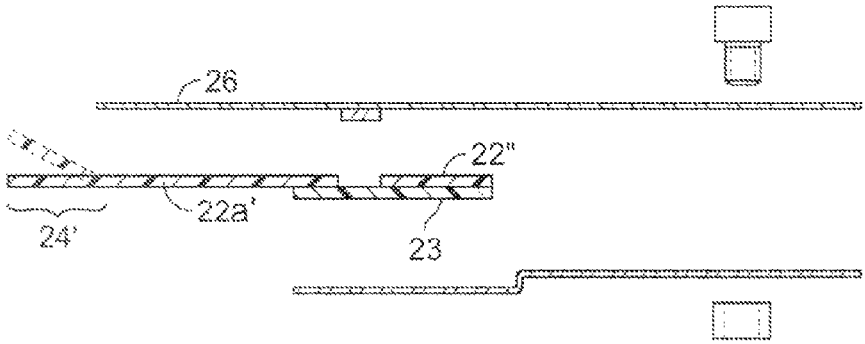
Figure 5A:
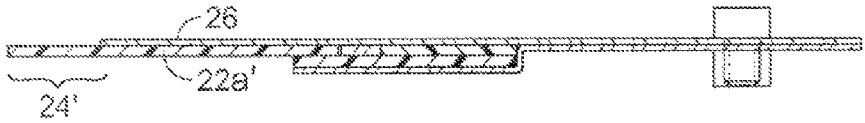
FIG. 5A is a similar view of the assembly.
Figure 6:
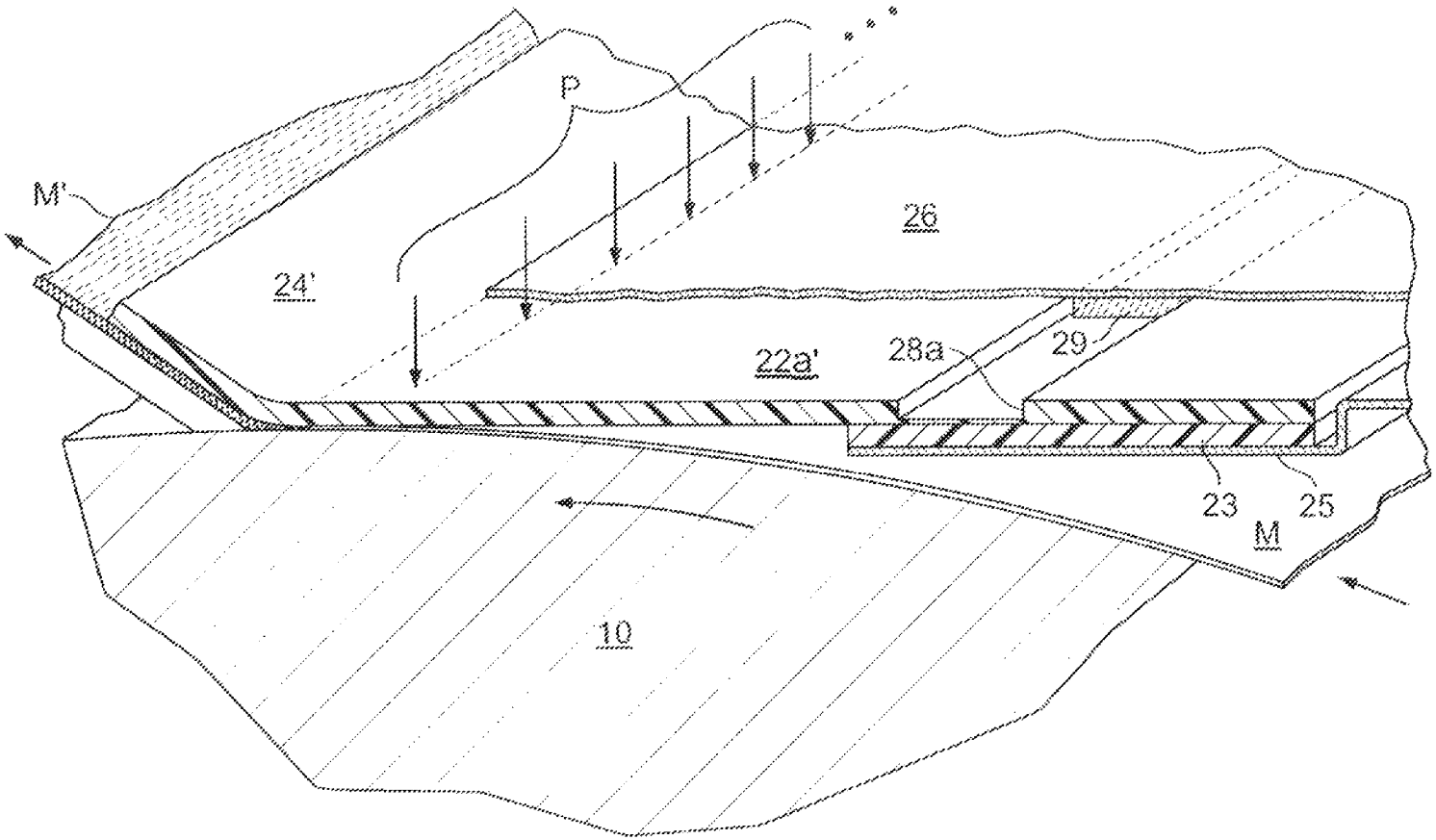
FIG. 6 is a diagrammatic, perspective view, similar to FIG. 4A, but with the operative parts of FIGS. 5 and 5A.

The example of FIGS. 5, 5A and 6 differs from that of FIGS. 3-3C and 4 in that, in place of the flexible member retarder 24, a forward extension 24' of the plastic primary member 22*a* extends beyond the forward edge of steel backing member 26, to be deflected to the position shown by retarder member 30. After a period of operation while deflected to this position, a permanent bend approximating this shape may be achieved.

Figure 5B:
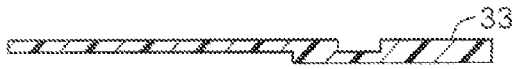
FIG. 5B is a cross-section of another primary member capable of performing in manner similar to that of FIG. 5A.

The example of FIG. 5B illustrates that the outer form of the primary and secondary members 22*a* and 23 of FIG. 5 may be achieved in a unitary member 33 of thermoplastic. This may be realized, for instance, by milling a sheet of relatively thick sheet stock or by other means, such as by injection molding.

Figure 7:
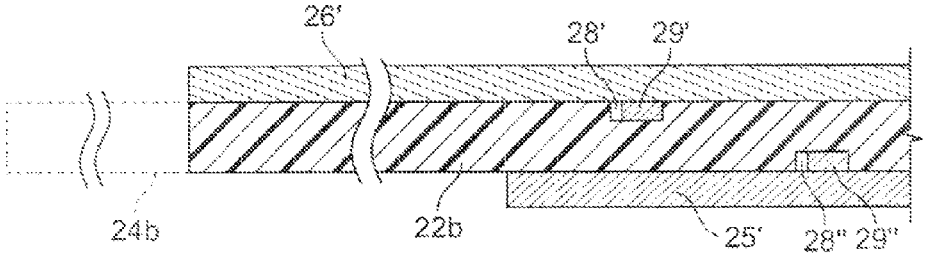
FIGS. 7 and 7A are magnified cross-sections of alternate versions of the primary member held between upper and lower mounting members.
Figure 7A:
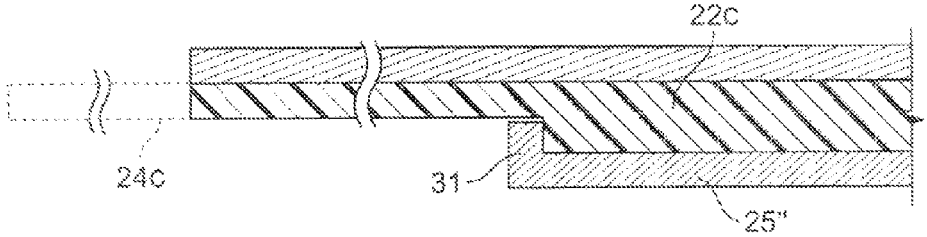

The examples of FIGS. 7 and 7A illustrate some alternative constructions for mounting sheet-form thermoplastic primary members. In FIG. 7, a pair of grooves 28' and 28" is formed in the thickness of the thermoplastic member 22*b*, each extending throughout the cross-machine extent of the primary member. As with the preceding figures, groove 28' is formed in the upper surface of the thermoplastic, into which is engaged a restraining member 29' carried by the upper steel member 26'. The second groove 28" is formed in the lower surface of the primary member, at a position offset in the machine direction from the first groove. It is engaged by a second restraining member 29" carried by the lower steel mounting member 25'. In the example of FIG. 7, the load imposed by the drag of the traveling flexible sheet material is shared between the rear surfaces of both grooves, so that the depth of each groove and the overall thickness of the primary member may accordingly be less than if only one groove were employed.

In FIG. 7A, the lower steel member 25" has a forward end in the form of a bend-resistant retaining lip 31. It extends upwardly, and cross-machine for the cross-machine extent of the primary member. It provides a suitably deep restraint surface e.g., of about 0.050 inch depth, against which a correspondingly deep, forwardly-directed surface or wall, at the end of a suitably thick lower portion of the primary member, may engage across the width of the machine. This, again, provides load-spreading restraint of the primary member against the drag effects of the traveling flexible sheet material while enabling cross-machine thermal expansion.

Figure 8:
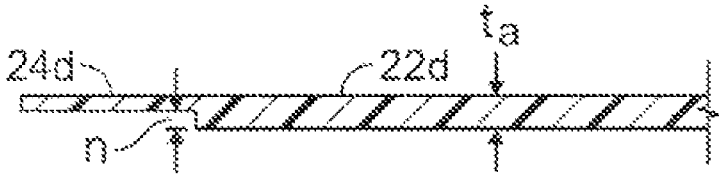
Figure 8A:
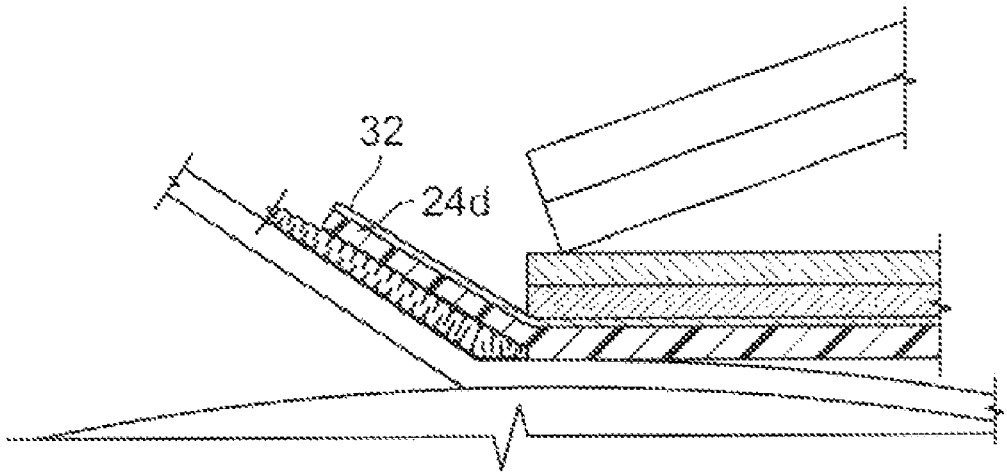
FIG. 8A illustrates the primary member of FIG. 8 in place, with material being treated in the cavity formed by the step.
Figure 8B:
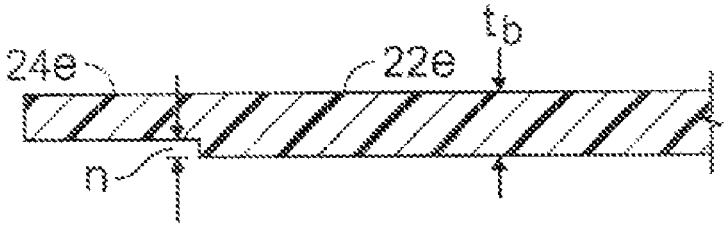
FIG. 8B is a view similar to FIG. 8 of a primary member of greater thickness, intended for use as shown in FIG. 8A but without backing by a flexible member.

In FIG. 8 is shown a thermoplastic primary member 22*d* similar to primary member 22 of FIG. 1B, but with a thinned extension 24*d*. While the upper surface of this extension is continuous with the surface of the main body of the member 22*d*, its lower, parallel surface is raised a predetermined amount n, relative to the under surface of the main body of primary member 22*d*. When installed in the machine, as shown in FIG. 8A, this adds a predetermined cavity depth n into which the propelled material M enters. Selection of this depth can desirably control the effect of the treatment on the traveling flexible material. For instance, with n=0.005 inch a finer microcrepe can be obtained in flexible material M than with n=0.010 inch, which in turn can produce a finer treatment than with a step of n=0.015 inch. The extension 24*d*, by its reduced thickness, is more flexible than would be the case if the extension were the same thickness as the main body. Where conditions require, a flexible supporting member 32, e.g. of spring steel, is interposed between the forward margin of primary member 22*d* and its above member. The forward extension of member 32 adds resilient support to the extension 24*d*. On the other hand, in the example of FIG. 8B, primary member 22*e* is of greater thickness $t_b$ than thickness $t_a$ of primary member 22*d* in FIG. 8, while the depth of the notch n may remain the same. The added thickness of the forward extension, 24*e*, contributes more stiffness to the extension, as may be desired, enabling omission of member 24*d* for additional support.

Figure 9:
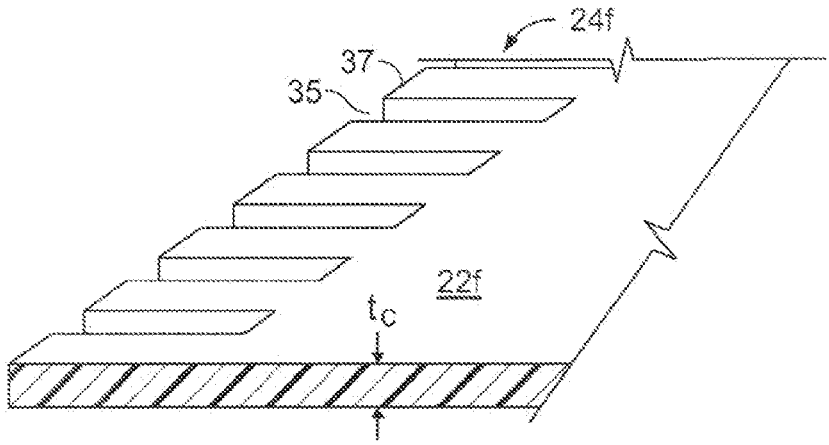
Figure 9A:
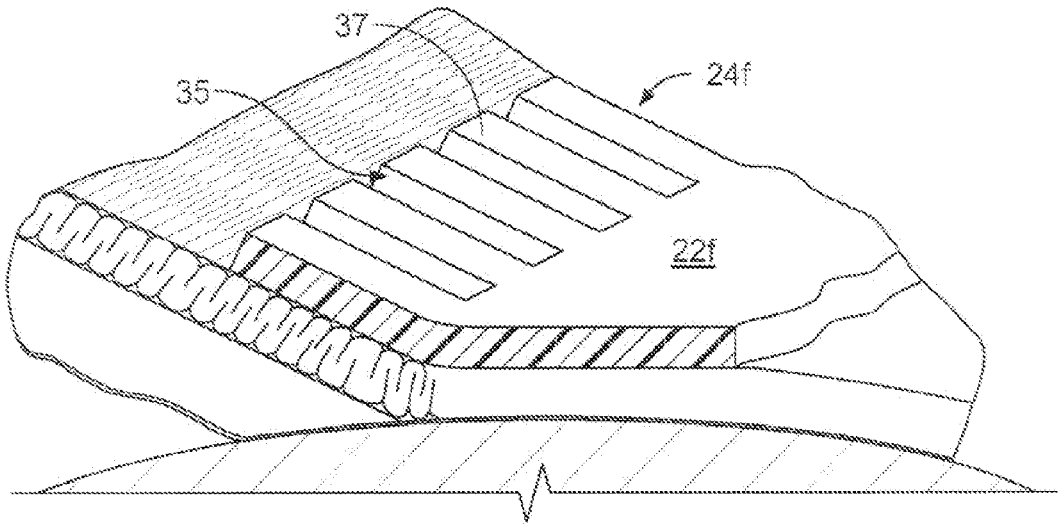
FIG. 9A is a perspective view showing the primary member in use on the machine.

The primary member 22*f* of FIG. 9 is the same as that of FIG. 2B, except, in its forward extension 24*f* there is a series of narrow, spaced-apart parallel slots 35 that extend in the machine direction. For instance, the slots may have a cross-machine dimension of 0.020 inch, be spaced apart 0.040 inch and have a machine-direction length of 0.75 inch. The material of the primary member remaining between these slots defines machine-direction fingers 37 that may respond independently to forward progress of the traveling flexible material. One desired effect is to provide a regular pattern of variations in the treatment cavity, and thereby in the nature of the treatment as suggested in FIG. 9A, the treatment being finer under the fingers than in the open spaces. One attainable effect, for instance, is to prevent formation of crepes that are continuous, and hence stiff, across the full width of the material being treated. The openings can thus introduce desired cross-machine flexibility to the treated material as well as provide desirable effects to its appearance. The openings may also serve as vent passages for vapors produced under the primary member by action of the heated roll, to avoid condensation on the machine surfaces that may be transferred to the material and produce blemishes.

Figure 10:
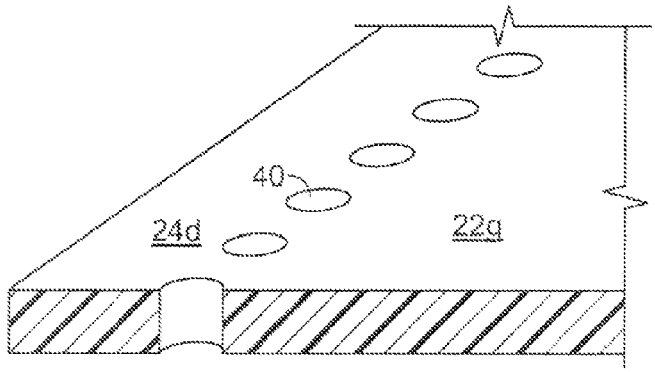
Figure 10A:
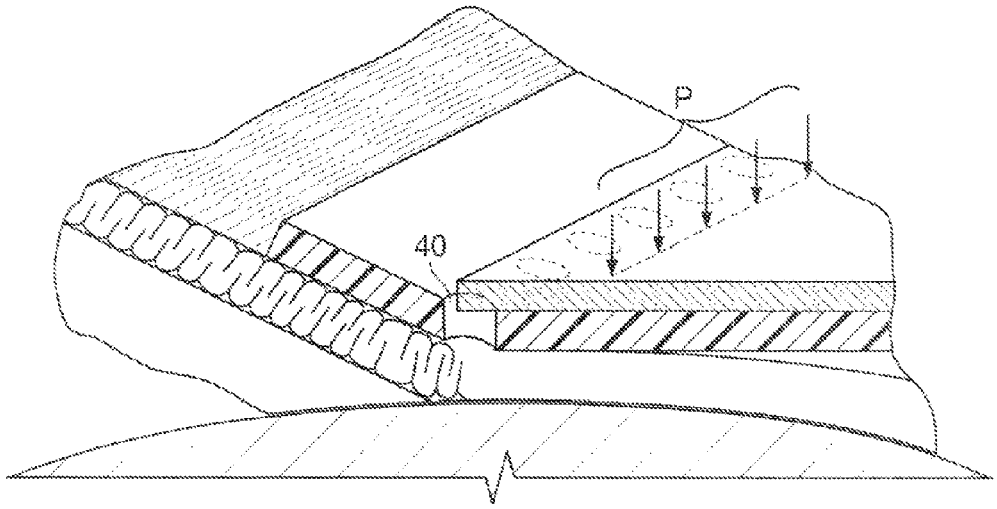
FIG. 10A is a perspective view showing the primary member in use on the machine.

In the example of FIG. 10, instead of the openings being slots through the thickness of the extension of the primary member, openings are formed by a series of holes through the thickness of member 22*g*. These provide a series of spaces into which the traveling material may temporarily expand as it is propelled forward, to provide a width-wise varying effect to the treatment. The holes may also serve as vent passages. The holes may be between about ⅛ inch and ½ inch diameter depending upon the effect desired, and spaced apart a corresponding distance. The forward extension 24*d* in this case is of continuous construction for aiding in applying retarding force to the treated material.

A number of implementations of plastic parts and their mounting have been described. Nevertheless, it will be understood that modifications may be made without departing from the spirit and scope of the invention. In particular, the thickness of at least 0.040 inch of the primary member can be positioned in the drive region in forms other than as part of a continuous sheet that has been shown. For instance, a cross-machine-extending bar of thermoplastic resin may be used to press the material against the drive roll. It may be shaped to define a forwardly-directed, linear load spreading surface for receiving restraint force by the restraint surface of a cooperating mounting member. This mounting may enable sliding in the axial direction for insertion and to accommodate thermal expansion. Accordingly, other embodiments are within the scope of the following claims.

What is claimed is:

1. Apparatus for longitudinally, compressively treating, substantially in the plane of the material, a selected traveling flexible material of substantial width, the apparatus comprising a drive roll having a gripping surface constructed to mechanically engage a first face of the material when the material is in a substantially dry, unadhering state, a stationary pressing member constructed and mounted so that in a drive region a face of the stationary pressing member can slippably engage and press face-wise against a second, opposite face of the material to force the first face of the material against the gripping surface of the roll to positively advance the material, and at least one stationary retarding member constructed and mounted to cause the retarding member to engage a face of the advancing material in a retarding region to retard the advancing material and cause compressive treatment of the material in a transition zone between the drive and retarding regions, wherein:

the stationary pressing member is a discrete sheet-form wear member of plastic held in position to cause one of its surfaces to continually, slippably engage and apply pressure to the second face of the traveling material for advancing the material, the plastic member having dimensions and being of such substance selected in respect of the selected material to be treated as to have physical integrity capable of performing its function.

2. The apparatus of claim 1 in which the pressing member comprises a primary member of sheet-form of thickness greater than about 0.040 inch, the sheet-form primary member being supported as a cantilever in a support region that precedes the drive region, the primary member being associated with a pressure device constructed to apply, in the drive region, adjustable pressure substantially in a concentrated width-wise-extending line to an outwardly exposed side of the sheet-form primary member, to force the opposite surface of the primary member of plastic to press the traveling material against the gripping surface of the drive roll to cause positive advance of the material.

3. The apparatus of claim 1 wherein in the retarding region a retarding passage is defined by two cooperating stationary retarding members arranged to continually, slippably engage opposite sides of the advancing sheet material in manner to apply retarding force as the treated material extrudes from between the two retarding members.

4. The apparatus of claim 3 wherein at least one of the retarding members is a sheet- or plate-form wear member of plastic held in position to cause one of its surfaces to continually, slippably engage and apply pressure to the face of the advancing material to promote retarding of the material.

5. The apparatus of claim 3 in which one of the retarding members is a retarder plate-form member located on the same side of the material as is the drive roll and having a material-engaging diverting surface positioned at a substantial angle to divert the direction of travel of the advancing material, and the cooperating retarder member is a cantilever confining member extending forward from the pressing member in the direction of material travel, the cooperating retarder member being bent or capable of being bent to converge relatively to and then to extend substantially parallel to the diverting surface of the plate-form retarder member, to form therewith an extruding passage through which the treated material is forced to extrude.

6. The apparatus of claim 5 in which the cooperating retarder member is a sheet-form wear member of plastic held in position to cause one of its surfaces to continually, slippably engage and apply pressure to the face of the advancing material to promote retarding of the material.

7. The apparatus of claim 6 in which the cooperating retarder member of the plastic is of thickness between about 0.005 inch and 0.015 inch and a support member is arranged to provide support to the outer side of the cooperating member.

8. The apparatus of claim 6 in which the cooperating retarder member of the plastic is a sheet-form member formed independently of the stationary pressing member, the cooperating retarding member having a rearward margin held against an outwardly directed surface of the pressing member for support.

9. The apparatus of claim 8 in which a sheet form support member engages an outwardly directed surface of the cooperating retarder member.

10. The apparatus of claim 6 in which the cooperating retarder member is an integral extension of the pressing member, forming therewith a unitary part comprised of the plastic.

11. The apparatus of claim 10 in which the integral extension is of substantially the same thickness as the plastic pressing member.

12. The apparatus of claim 10 in which there is a series of openings in the material-engaging surface of the cooperating retarder member, the series of openings extending across the width of the traveling material.

13. The apparatus of claim 12 in which the openings comprise parallel slots extending in the direction of the travel of the flexible material.

14. The apparatus of claim 5 in which the plate-form retarder is a wear member of plastic held in position to cause one of its surfaces to continually, slippably engage the face of the advancing material to promote retarding of the material.

15. The apparatus of claim 14 in which the cooperating retarder member is a sheet-form wear member of plastic held in position to cause one of its surfaces to continually, slippably engage and apply pressure to the face of the advancing material to promote retarding of the material.

16. The apparatus of claim 1, 4 or 14 in which the plastic is comprised substantially of a plastic resin selected from the group consisting of ultra high molecular weight polyethylene, nylon, polyetheretherketone and copolymers and compatible blends in which one or more of the foregoing is a constituent.

17. The apparatus of claim 1, 4 or 14 in which the plastic has a wear coefficient less than about 100 under the test ASTM G-65.

18. The apparatus of claim 1, 4 or 14 in which the plastic has a coefficient of friction of about 0.15 or less under the test ASTM D-1894.

19. The apparatus of claim 1, 4 or 14 adapted to longitudinally compressively treat a predetermined flexible sheet material having a predetermined treatment temperature, the plastic selected to be stable at that temperature, to have a wear coefficient less than about 100 under the test ASTM G-65 and to have a coefficient of friction of about 0.15 or less under the test ASTM D-1894.

20. The apparatus of claim 1 adapted to longitudinally compressively treat a flexible sheet material comprised of a polyolefin resin and the plastic is comprised substantially of a selected polyolefin or a copolymer or compatible blend in which it is a constituent.

21. The apparatus of claim 20 in which the plastic is substantially comprised of ultra high molecular weight polyethylene or a copolymer or compatible blend in which it is a constituent.

22. The apparatus of claim 1 adapted to longitudinally compressively treat the material at a temperature of treatment under about 220 F, and the plastic is comprised substantially of ultra high molecular weight polyethylene, nylon or polyetheretherketone or a copolymer or compatible blend in which one of the foregoing is a constituent.

23. The apparatus of claim 1 adapted to longitudinally compressively treat the material at a temperature of treatment above about 220 F, and the plastic is comprised substantially of nylon 6,6 or polyetheretherketone or a copolymer or compatible blend in which one of the foregoing is a constituent.

24. The apparatus of claim 1 adapted to longitudinally, compressively treat substantially dry flexible sheet material comprised of wood pulp at an operating speed of about 800 feet per minute or greater, the plastic selected to have a wear coefficient less than about 100 under the test ASTM G-65.

25. The apparatus of claim 24 in which the plastic has a coefficient of friction of about 0.15 or less under the test ASTM D-1894.

26. The apparatus of claim 1 adapted to longitudinally, compressively treat a substantially dry flexible sheet material comprised of wood pulp at an operating speed of about 800 feet per minute or greater, and the plastic is comprised substantially of ultra high molecular weight polyethylene, nylon or polyetheretherketone or a copolymer or compatible blend in which one of the foregoing is a constituent.

27. The apparatus of claim 1, 4 or 14 in which the selected material carries a substance that is subject to migration to the plastic and the plastic is selected to resist or interfere with adhesion of the migratory substance.

28. The apparatus of claim 27 in which the plastic is a plastic resin that includes a filler of a substance that resists or interferes with adhesion of the migratory substance.

29. The apparatus of claim 28 in which the plastic is an oil-filled plastic.

30. The apparatus of claim 29 in which the selected material to be treated is comprised of polyethylene or a copolymer or blend in which polyethylene is a substantial constituent, the migratory substance is ink and the plastic is comprised substantially of an oil-filled nylon.

31. A method comprising providing the apparatus of claim 1 and longitudinally compressively treating therewith a predetermined flexible sheet material at least substantially comprised of a polyolefin resin, wherein the pressing member employed in the treatment is comprised substantially of a selected polyolefin or a copolymer or compatible blend in which one of the foregoing is a constituent.

32. The method of claim 31 in which the pressing member is comprised at least substantially of ultra high molecular weight polyethylene.

33. The method of claim 32 in which the flexible sheet material is at least substantially comprised of polypropylene.

34. The method of claim 32 in which the flexible sheet material is at least substantially comprised of polyethylene.

35. A method comprising providing the apparatus of claim 1 and longitudinally compressively treating therewith a predetermined flexible sheet material at temperature below about 220 F, wherein the pressing member employed in the treatment is comprised substantially of ultra high molecular weight polyethylene, nylon or polyetheretherketone or a copolymer or compatible blend in which one of the foregoing is a constituent.

36. A method comprising providing the apparatus of claim 1, and longitudinally compressively treating therewith a predetermined flexible sheet material at temperature of treatment above about 220 F, wherein the pressing member employed in the treatment is comprised substantially of nylon 6,6 or polyetheretherketone or a copolymer or compatible blend in which one of the foregoing is a constituent.

37. A method comprising providing the apparatus of claim 1, and longitudinally compressively treating therewith a predetermined substantially dry flexible sheet material comprised substantially of wood pulp, the plastic of the pressing member comprising substantially a resin selected from the group consisting of ultra high molecular weight polyethylene, nylon 6, 6 and polyetheretherketone or a copolymer or compatible blend in which one of the foregoing is a constituent.

38. The method of claim 37 in which the wood pulp is recycled pulp and the pressing member is comprised substantially of ultra high molecular weight polyethylene.

39. The method of claim 31 in which the selected material carries a substance that is subject to migration to the stationary member and the stationary member is comprised of a plastic selected to resist or interfere with adhesion of the migratory substance.

40. The method of claim 39 in which the plastic is a plastic that includes a substance that resists or interferes with adhesion of the migratory substance.

41. The method of claim 40 in which the plastic is an oil-filled plastic.

42. The method of claim 41 in which the selected material to be treated is comprised of polyethylene or a copolymer or blend in which polyethylene is a substantial constituent, the migratory substance is ink and the plastic is an oil-filled nylon.

43. The apparatus of claim 2 having a material-engaging device which includes the primary member of plastic and at least one support member having a coefficient of thermal expansion substantially lower than that of the primary member of plastic, the material-engaging device including a mounting of the primary member constructed to permit its free cross-machine thermal expansion relative to the support member having the lower coefficient of thermal expansion.

44. The apparatus of claim 2 in which the primary member of plastic defines at least one extended load-spreading surface disposed in the cross-machine direction and facing in the direction of advance of the traveling material and a mounting includes a corresponding restraint surface engaged upon the load-spreading surface to resist drag force applied by the traveling material to the primary member.

45. The apparatus of claim 44 in which the load-spreading surface of the plastic primary member and the corresponding restraint surfaces are linear surfaces constructed and arranged to be slideably engaged during assembly.

46. The apparatus of claim 44 in which the extended load-spreading surface is a linear surface that is disposed parallel to the axis of the drive roll, and the restraint surface is correspondingly linear and is slideably engaged upon the load-spreading surface to permit free cross-machine thermal expansion of the primary member of plastic.

47. The apparatus of claim 44 in which the load-spreading surface is provided by a wall formation of the primary member.

48. The apparatus of claim 47 in which the wall bounds a groove formed in the plastic body of the primary member.

49. The apparatus of claim 44 in which the primary member is held between upper and lower mounting members that form part of an assembly, at least one of the mounting members providing a said restraint surface engaged upon the load-spreading surface to resist drag force applied by the traveling material to the primary member.

50. The apparatus of claim 49 in which the mounting member extends forward over an upper face of the primary member to an end lying forward, beyond the line of action of the pressing device and the lower mounting member extends forward to an end located to the rear of the pressing device.

51. The apparatus of claim 50 in which a linear load-spreading surface of the primary member is the forwardly directed rear wall of a groove formed in an upper or lower surface of the primary member and the linear restraint surface is defined by a rearwardly directed surface of a formation provided by the corresponding mounting member.

52. The apparatus of claim 49 in which portions of the assembly to the rear of the primary member are joined by a cross-machine series of fasteners held in a corresponding groove of a holder.

53. A stationary pressing member constructed for use in apparatus for longitudinally, compressively treating, substantially in the plane of the material, a selected traveling flexible material of substantial width, the apparatus comprising a drive roll having a gripping surface constructed to mechanically engage a first face of the material when the material is in a substantially dry, unadhering state, a stationary pressing member constructed and mounted so that in a drive region a face of the stationary pressing member can slippably engage and press face-wise against a second, opposite face of the material to force the first face of the material against the gripping surface of the roll to positively advance the material, and at least one stationary retarding member constructed and mounted to cause the retarding member to engage a face of the advancing material in a retarding region to retard the advancing material and cause compressive treatment of the material in a transition zone between the drive and retarding regions, wherein the stationary pressing member is a discrete sheet-form wear member of plastic adapted to be held in position to cause one of its surfaces to continually, slippably engage and apply pressure to the second face of the traveling material for advancing the material, the plastic member having dimensions and being of such substance selected in respect of the selected material to be treated as to have physical integrity capable of performing its function.

54. The pressing member of claim 53 comprising a primary member of sheet-form of thickness greater than about 0.040 inch, the sheet-form primary member being constructed to be supported as a cantilever in a support region that precedes the drive region of the apparatus, the primary member being constructed to be associated with a pressure device constructed to apply, in the drive region, adjustable pressure substantially in a concentrated width-wise-extending line to an outwardly exposed side of the sheet-form primary member, to force the opposite surface of the primary member of plastic to press the traveling material against the gripping surface of the drive roll to cause positive advance of the material.

55. The pressing member of claim 53 in which the plastic is comprised substantially of plastic resin selected from the group consisting of ultra high molecular weight polyethylene, nylon, polyetheretherketone and copolymers and compatible blends in which one or more of the foregoing is a constituent.

56. The pressing member of claim 53 in which the plastic has a wear coefficient less than about 100 under the test ASTM G-65.

57. The pressing member of claim 53 in which the plastic has a coefficient of friction of about 0.15 or less under the test ASTM D-1894.

58. The pressing member of claim 53 adapted to longitudinally compressively treat a predetermined flexible sheet material having a predetermined treatment temperature, the plastic of the pressing member selected to be stable at that temperature and to have a wear coefficient less than about 100 under the test ASTM G-65 and to have a coefficient of friction of about 0.15 or less under the test ASTM D-1894.

59. The pressing member of claim 53 adapted to longitudinally compressively treat a flexible sheet material comprised of a polyolefin resin and the plastic is comprised substantially of a selected polyolefin or a copolymer or compatible blend in which it is a constituent.

60. The pressing member of claim 59 in which the plastic is substantially comprised of ultra high molecular weight polyethylene or a copolymer or compatible blend in which it is a constituent.

61. The pressing member of claim 53 adapted to longitudinally compressively treat the material at a temperature of treatment under about 220 F, and the plastic is comprised substantially of ultra high molecular weight polyethylene, nylon or polyetheretherketone or a copolymer or compatible blend in which one of the foregoing is a constituent.

62. The pressing member of claim 53 adapted to longitudinally compressively treat the material at a temperature of treatment above about 220 F, and the plastic is comprised substantially of nylon 6,6 or polyetheretherketone or a copolymer or compatible blend in which one of the foregoing is a constituent.

63. The pressing member of claim 53 adapted to longitudinally compressively treat substantially dry flexible sheet material comprised of wood pulp at an operating speed of about 800 feet per minute or greater, the plastic selected to have a wear coefficient less than about 100 under the test ASTM G-65.

64. The pressing member of claim 63 in which the plastic has a coefficient of friction of about 0.15 or less under the test ASTM D-1894.

65. The pressing member of claim 63 adapted to longitudinally, compressively treat substantially dry flexible sheet material comprised of wood pulp at an operating speed of about 800 feet per minute or greater, wherein the plastic is of ultra high molecular weight polyethylene, nylon or polyetheretherketone or a copolymer or compatible blend in which one of the foregoing is a constituent.

66. The pressing member of claim 53 in which the selected material to be treated carries a substance that is subject to migration to the plastic and the plastic is selected to resist or interfere with adhesion of the migratory substance.

67. The pressing member of claim 66 in which the plastic includes a filler of a substance that resists or interferes with adhesion of the migratory substance.

68. The pressing member of claim 66 in which the plastic is an oil-filled plastic.

69. The pressing member of claim 66 in which the selected material to be treated is comprised of polyethylene or a copolymer or blend in which polyethylene is a substantial constituent, the migratory substance is ink and the plastic is comprised substantially of an oil-filled nylon.

70. The pressing member of claim 53 for use where the material-engaging device includes at least one mounting member having a coefficient of thermal expansion substantially lower than that of the pressing member of plastic, the pressing member defining an elongated slide surface constructed to slide relative to the mounting member to permit free cross-machine thermal expansion of the pressing member relative to the mounting member.

71. The pressing member of claim 53 for use in apparatus in which the retarder is a retarding blade disposed to engage the driven side of the sheet material after it has left the drive roll, the pressing member having an extension of the plastic constructed to extend beyond the pressing region to continually, slippably engage the opposite side of the traveling sheet material as it moves along the retarding blade.

72. The pressing member of claim 71 in which the extension has a lower surface disposed to engage the sheet material lying a step above rearward portions of the lower surface of the pressing member.

73. The pressing member of claim 71 in which the extension defines a cross-machine series of openings.

74. The pressing member of claim 73 in which the openings comprise a series of slots.

75. The pressing member of claim 74 in which the slots are through-slots defining machine-direction fingers therebetween.

76. The pressing member of claim 74 in which the openings are defined by holes through the pressing member.

77. The pressing member of claim 53 in sheet form and disposed in a mounting assembly comprising a pair of sheet-form mounting members that have a common region joined face to face, the mounting members mutually extending forward therefrom over a region in which the pressing member of the plastic is held between the members, the upper sheet-form member extending forward as a backing to the plastic pressing member, to a pressing region at which the upper member can receive downward pressure, and transmit that pressure to the plastic pressing member, to cause the face of the pressing member to engage upon the corresponding face of traveling sheet material, and the lower mounting member terminating short of the portion of the pressing member exposed to engage the sheet material.

78. The pressing member of claim 53 having a downward pressure-transmitting face of cross-machine extent that substantially exceeds the corresponding width of a predetermined flexible sheet material to be treated, cross-machine end portions of the member extending beyond corresponding edges of the predetermined material.

* * * * *